US006896571B2

(12) United States Patent
Mizuno et al.

(10) Patent No.: US 6,896,571 B2
(45) Date of Patent: May 24, 2005

(54) METHODS OF MANUFACTURING ELECTRON-EMITTING DEVICE, ELECTRON SOURCE, AND IMAGE DISPLAY APPARATUS

(75) Inventors: Hironobu Mizuno, Kanagawa (JP); Takashi Iwaki, Tokyo (JP); Toshihiko Takeda, Kanagawa (JP); Noritake Suzuki, Kanagawa (JP); Kazuya Miyazaki, Kanagawa (JP); Koki Nukanobu, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 157 days.

(21) Appl. No.: 10/372,853

(22) Filed: Feb. 26, 2003

(65) Prior Publication Data

US 2003/0162465 A1 Aug. 28, 2003

(30) Foreign Application Priority Data

Feb. 28, 2002 (JP) ..... 2002-054342
Jan. 31, 2003 (JP) ..... 2003-022953

(51) Int. Cl.[7] ..... H01J 9/04

(52) U.S. Cl. ..... 445/24; 445/5; 445/51; 438/20

(58) Field of Search ..... 445/3, 5, 6, 24, 445/25, 49–51; 313/495–497, 346 R; 438/20

(56) References Cited

U.S. PATENT DOCUMENTS

| | | | | |
|---|---|---|---|---|
| 4,904,895 | A | 2/1990 | Tsukamoto et al. | 313/336 |
| 5,066,883 | A | 11/1991 | Yoshioka et al. | 313/309 |
| 5,605,483 | A | 2/1997 | Takeda et al. | 445/2 |
| 5,749,763 | A | 5/1998 | Yoshioka et al. | 445/51 |
| 6,123,876 | A | 9/2000 | Kobayashi et al. | 252/519.2 |
| 6,179,678 | B1 | 1/2001 | Kishi et al. | 445/24 |
| 6,221,426 | B1 | 4/2001 | Yamanobe | 427/77 |

(Continued)

FOREIGN PATENT DOCUMENTS

| | | | |
|---|---|---|---|
| EP | 0 788 130 A2 | 8/1997 | |
| EP | 0 803 890 A1 | 10/1997 | |
| EP | 0 986 085 A2 | 3/2000 | |
| EP | 1 124 247 A1 | 8/2001 | |
| EP | 1 184 886 A1 | 3/2002 | H01J/9/02 |
| JP | 7-65704 | 3/1995 | |
| JP | 8-55563 | 2/1996 | |
| JP | 08-321254 | 3/1996 | H01J/1/30 |
| JP | 9-161666 | 6/1997 | |
| JP | 09-237571 | 9/1997 | H01J/9/02 |
| JP | 11-120901 | 4/1999 | H01J/9/02 |

OTHER PUBLICATIONS

Baba et al., "Field Emission from an Ion–Beam–Modified Polyimide Film," Jpn. J. Appl. Phys., V. 38, pp. L 261–L263 (1999).

*Primary Examiner*—Nimeshkumar D. Patel
*Assistant Examiner*—German Colón
(74) *Attorney, Agent, or Firm*—Fitzpatrick, Cella, Harper & Scinto

(57) ABSTRACT

In a process of reducing a resistivity of a polymer film for carbonization in a surface conduction electron-emitting device, by irradiating an energy beam onto the polymer film, when an energy intensity of the beam given in a unit area in a unit time is assumed to be W W/m$^2$, W satisfies a formula $W \geqq 2 \times T \times (\rho_{sub} \cdot C_{sub} \cdot \lambda_{sub} / \tau)^{1/2}$, where T is defined as a temperature ° C. at which the polymer film is heated for one hour in a vacuum degree of $1 \times 10^{-4}$ Pa to reduce a resistivity of the polymer film to 0.1 Ω·cm, $C_{sub}$ is a specific heat J/kg·K of the substrate, $\rho_{sub}$ is a specific gravity kg/m$^3$ of the substrate, $\lambda_{sub}$ is a heat conductivity W/m·K of the substrate, and τ is an irradiation time in the range of $10^{-9}$ sec to 10 sec.

15 Claims, 18 Drawing Sheets

U.S. PATENT DOCUMENTS

| | | | | |
|---|---|---|---|---|
| 6,225,749 | B1 | 5/2001 | Kobayashi et al. | 315/169.3 |
| 6,246,168 | B1 | 6/2001 | Kishi et al. | 313/495 |
| 6,267,636 | B1 | 7/2001 | Onishi et al. | 445/6 |
| 6,313,815 | B1 | 11/2001 | Takeda et al. | 345/75.2 |
| 6,334,803 | B1 | 1/2002 | Shibata | 445/51 |
| 6,348,761 | B1 | 2/2002 | Nomura et al. | 313/495 |
| 6,379,211 | B1 | 4/2002 | Onishi et al. | 445/73 |
| 6,383,047 | B1 | 5/2002 | Minami et al. | 445/6 |
| 6,445,367 | B1 | 9/2002 | Suzuki et al. | 345/75.2 |
| 6,473,063 | B1 | 10/2002 | Suzuki et al. | 345/74.1 |
| 6,492,769 | B1 | 12/2002 | Oda et al. | 313/495 |
| 6,515,640 | B1 | 2/2003 | Tsukamoto et al. | 345/75.2 |
| 6,534,924 | B1 | 3/2003 | Oguchi et al. | 315/169.1 |
| 6,566,794 | B1 | 5/2003 | Miyazaki | 313/292 |
| 6,781,667 | B1 * | 8/2004 | Horiguchi et al. | 349/187 |
| 2001/0054865 | A1 | 12/2001 | Danjo et al. | 313/495 |
| 2002/0081931 | A1 | 6/2002 | Iwaki et al. | 445/6 |
| 2002/0117670 | A1 | 8/2002 | Horiguchi et al. | 257/59 |
| 2003/0039767 | A1 | 2/2003 | Mizuno et al. | 427/595 |
| 2003/0073371 | A1 | 4/2003 | Iwaki | 445/24 |
| 2003/0160180 | A1 | 8/2003 | Arai et al. | 250/424 |
| 2003/0161942 | A1 | 8/2003 | Arai et al. | 427/77 |
| 2003/0162464 | A1 | 8/2003 | Kyogaku et al. | 445/24 |
| 2003/0162467 | A1 | 8/2003 | Shimazu et al. | 445/50 |

* cited by examiner

METHODS OF MANUFACTURING ELECTRON-EMITTING DEVICE, ELECTRON SOURCE, AND IMAGE DISPLAY APPARATUS

BACKGROUND OF THE INVENTION

1. Field of the Invention

The present invention relates to a method of manufacturing an electron-emitting device, a method of manufacturing an electron source by processing units into a large number of electron-emitting devices, and a method of manufacturing an image-forming apparatus, such as an image display apparatus, which is structured by using the electron source.

2. Related Background Art

Up to now, a surface conduction electron-emitting device has been known as an electron-emitting device.

A structure, a manufacturing method, and the like of the surface conduction electron-emitting device are disclosed, for example, in Japanese Patent Laid-open Gazette No. 8-321254.

A structure of a typical surface conduction electron-emitting device disclosed in the above-mentioned publication or the like is schematically shown in FIGS. 13A and 13B, which are respectively a plan view and a sectional view of the surface conduction electron-emitting device disclosed in the above-mentioned publication or the like.

In FIGS. 13A and 13B, reference numeral 131 denotes a substrate, 132 and 133 denote a pair of electrodes facing each other, 134 denotes a conductive film, 135 denotes a second gap, 136 denotes a carbon coating film, and 137 denotes a first gap.

An example of a manufacturing process of the electron-emitting device constructed as in FIGS. 13A and 13B is schematically shown in FIGS. 14A to 14D.

The pair of electrodes 132 and 133 are first formed on the substrate 131 (FIG. 14A).

Subsequently, the conductive film 134 for connecting between the electrodes 132 and 133 is formed (FIG. 14B).

Then, a current is made to flow between the electrodes 132 and 133, and the so-called "energization forming step" is performed for forming the second gap 135 in a part of the conductive film 134 (FIG. 14C).

Further, in a carbon compound atmosphere, a voltage is applied between the electrodes 132 and 133 to perform the so-called "activation step" by which the carbon coating film 136 is formed on a part of the substrate 131 within the area of the second gap 135 and is also formed on a part of the conductive film 134 in the vicinity of the second gap 135, thus forming electron-emitting device (FIG. 14D).

On the other hand, another method of manufacturing a surface conduction electron-emitting device is disclosed in Japanese Patent Laid-open Gazette No. 9-237571.

An image-forming apparatus such as a flat display panel can be structured by combining an electron source structured by arranging a plurality of electron-emitting devices formed in accordance with the above-described manufacturing method and an image-forming member comprised of a phosphor or the like.

In the above-described conventional device, a technical device is provided in which an "activation step" and the like are performed in addition to the "energization forming step", whereby, in the inside of the second gap 135 formed by the "energization forming step", the carbon film 136, which is formed of carbon or a carbon compound and which has the first gap 137 narrower than the second gap 135, is arranged to obtain satisfactory electron-emitting characteristics.

SUMMARY OF THE INVENTION

However, manufacturing of an image-forming apparatus that uses such a conventional electron-emitting device has the following problems.

That is, the manufacturing includes many additional steps such as repeated energization steps in the "energization forming step" and the "activation step" and a step of forming a preferable atmosphere in each step, and thus, management of respective steps has been complicated.

Further, in the case where the electron-emitting device is used for an image-forming apparatus such as a display, further improvement in electron-emitting characteristics is desired in order to save power consumption of the apparatus.

Moreover, it is desired that the image-forming apparatus that uses the electron-emitting device is manufactured easier and simpler and at lower cost.

The present invention has been made in view of the above, and therefore has an object to provide a method of manufacturing an electron-emitting device which particularly attains simplification of manufacturing steps of the electron-emitting device and improvement of electron-emitting characteristics, a method of manufacturing an electron source, and a method of manufacturing an image-forming apparatus.

The present invention has been made as a result of extensive studies for solving the above-mentioned problems and has the structures described below.

That is, according to a first aspect of the present invention, a method for manufacturing an electron-emitting device, comprises the steps of:

(A) providing a substrate on which a pair of electrodes and a polymer film are arranged, the polymer film connecting the electrodes;

(B) reducing a resistivity of the polymer film by irradiating an energy beam onto the polymer film; and (C) forming a gap in a film obtained by reducing a resistivity of the polymer film, wherein, in the step (B), assuming that an energy intensity of the beam given in a unit area in a unit time as W W/m$^2$, W satisfies a formula $W \geqq 2 \times T \times (\rho_{sub} \cdot C_{sub} \cdot \lambda_{sub} / \tau)^{1/2}$, where T is defined as a temperature ° C. at which the polymer film is heated for one hour in a vacuum degree of $1 \times 10^{-4}$ Pa to reduce a resistivity of the polymer film measured at a room temperature to 0.1 Ω·cm, $C_{sub}$ is a specific heat J/kg·K of the substrate, $\rho_{sub}$ is a specific gravity kg/m$^3$ of the substrate, $\lambda_{sub}$ is a thermal conductivity W/m·K of the substrate, and τ is an irradiation time in the range of $10^{-9}$ sec to 10 sec.

According to a second aspect of the present invention, a method for manufacturing an electron-emitting device comprises the steps of:

(A) providing a substrate on which a pair of electrodes and a polymer film are arranged, the polymer film connecting the electrodes, (B) reducing a resistivity of the polymer film; and (C) forming a gap in a film obtained by reducing the resistivity of the polymer film in the vicinity of one of the pair of electrodes, by flowing a current to the film obtained by reducing the resistivity of the polymer film, wherein the film obtained by reducing the resistivity of the polymer film has an activation energy for electrical conduction of 0.3 eV or less.

According to a third aspect of the present invention, a method for manufacturing an electron-emitting device comprises the steps of:

(A) arranging a pair of electrodes on a substrate;

(B) arranging a conductive film on the substrate, the conductive film connecting the electrodes and having an activation energy for electrical conduction of 0.3 eV or less; and (C) forming a gap in the conductive film in the vicinity of one of the pair of electrodes by flowing a current to the conductive film.

According to a fourth aspect of the present invention, a method for manufacturing an electron-emitting device, comprising the steps of:

(A) providing a substrate on which a polymer film is arranged;

(B) reducing a resistivity of the polymer film by irradiating an energy beam onto the polymer film; and wherein, in the step (B), assuming that an energy intensity of the beam given in a unit area in a unit time as W $W/m^2$, W satisfies a formula $W \geqq 2 \times T \times (\rho_{sub} \cdot C_{sub} \cdot \lambda_{sub}/\tau)^{1/2}$, where T is defined as a temperature ° C. at which the polymer film is heated for one hour in a vacuum degree of $1 \times 10^{-4}$ Pa to reduce a resistivity of the polymer film measured at a room temperature to 0.1 Ω·cm, $C_{sub}$ is a specific heat J/kg·K of the substrate, $\rho_{sub}$ is a specific gravity $kg/m^3$ of the substrate, $\lambda_{sub}$ is a thermal conductivity W/m·K of the substrate, and τ is an irradiation time in the range of $10^{-9}$ sec to 10 sec.

In the step of reducing the resistivity of the polymer film of the first and fourth aspects, when τ is taken in the range of $10^{-9}$ sec to 1 sec, the energy intensity W preferably further satisfies a formula $W \geqq A \times T \times (\rho_{sub} \cdot C_{sub} \cdot \lambda_{sub})^{1/2} \times \tau^{-\gamma}$, where A is a constant and $2.5 \leqq A \leqq 3.0$, γ is a constant and satisfies $0.5 \leqq \gamma \leqq 0.6$.

In the first and fourth aspects, an activation energy necessary for reducing the resistivity of the polymer film to 0.1 Ω·cm or less is preferably 4 eV or less; the energy beam is preferably irradiated onto the polymer film plural times. The step (B) of the second aspect further includes the step of irradiating an energy beam onto the polymer film and the conductive film contains carbon as a main component.

In the embodiments of the present invention, the energy beam is preferably a particle beam selected from a group of electron beam and ion beam or is a light beam emitted from a light source selected from a group of a laser, a xenon light source (such as a xenon lamp) and a halogen light source (such as a halogen lamp); and the polymer is preferably made of at least one selected from a group consisting of aromatic polyimide, polyphenylene oxadiazole, and polyphenylene vinylene.

In the third aspect, the conductive film contains carbon as a main component.

According to a fifth aspect, there is provided a method of manufacturing an electron source having a plurality of electron-emitting devices, wherein each of the electron-emitting devices is manufactured by a method for manufacturing an electron-emitting device as set forth in one of the above aspects.

According to a sixth aspect, there is provided a method of manufacturing an image display apparatus that comprises: an electron source having a plurality of electron-emitting devices; and a light emitting member for emitting light when being irradiated by of electrons emitted from the electron source, wherein the electron source is manufactured by a method for manufacturing an electron source as set forth in the fifth aspect.

The embodiments according to the present invention further comprises a step of:

flowing a current between the electrodes by applying a voltage between the electrodes under a reduced pressure atmosphere after the gap has been formed, wherein the voltage applied between the electrodes is a pulse voltage with a fixed peak value, and a pulse width of the pulse voltage is larger than a pulse width used at the time of actual drive of forming an image or wherein the voltage applied between the electrodes is a pulse voltage with a fixed peak value, and a pulse duty defined by a ratio of pulse width to pulse period is larger than a pulse duty used at the time of actual drive of forming an image, and wherein the voltage applied between the electrodes is a pulse voltage with a fixed peak value, and a pulse interval of the pulse voltage is shorter than a pulse interval used at the time of actual drive of forming an image.

The present invention is not limited to a method of manufacturing a carbon film in the surface conduction electron-emitting device. The present invention is applicable to a process for manufacturing films used in various electronic devices such as electron-emitting device, battery and etc. which include conduction carbon films. Accordingly, the essence of the present invention applicable to those various electronic device manufacturing processes comprises a step of providing a polymer film on a substrate and a step of irradiating an energy beam onto the polymer film with the energy intensity $W \geqq 2 \times T \times (\rho_{sub} \cdot C_{sub} \cdot \lambda_{sub}/\tau)^{1/2}$.

DETAILED DESCRIPTION OF THE PREFERRED EMBODIMENTS

Embodiment Mode

Hereinafter, description will be made of embodiment modes of the present invention. However, the present invention is not limited to these embodiment modes.

Figure 1A:
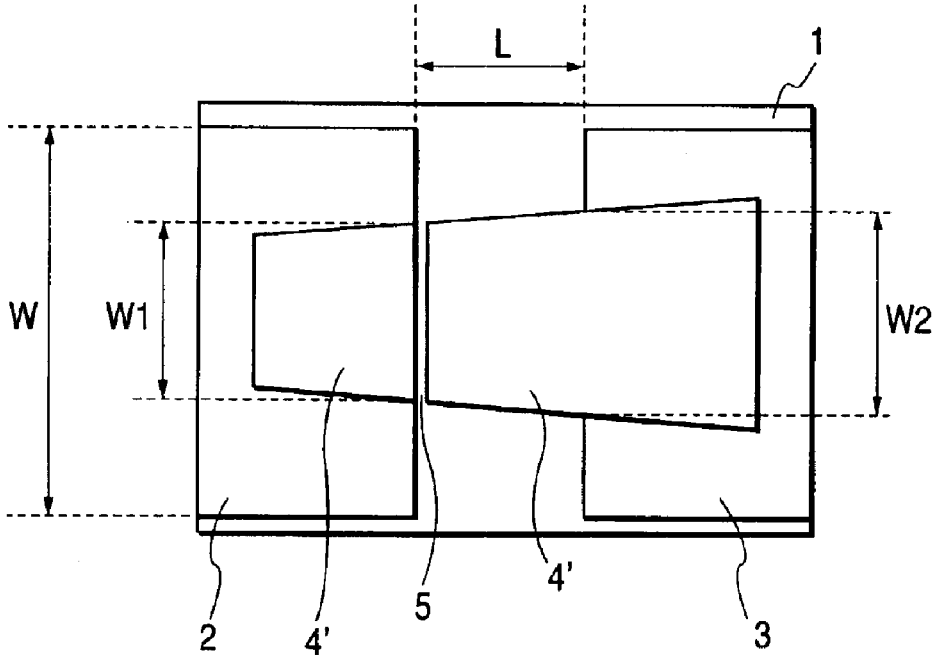
FIGS. 1A and 1B are a schematic plan view and a schematic sectional view showing an example of an electron-emitting device of the present invention, respectively.
Figure 1B:
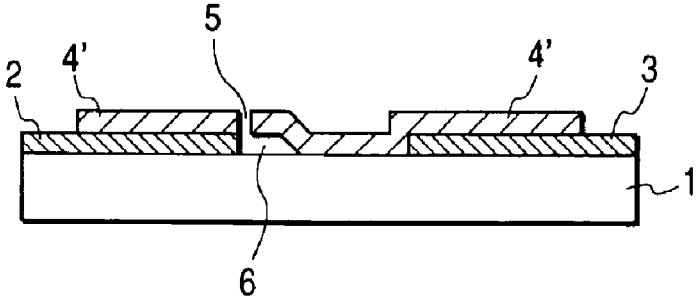

FIGS. 1A and 1B are diagrams schematically showing an example of the electron-emitting device according to the present invention. Note that FIG. 1A is a plan view and FIG. 1B is a sectional view f substantially vertical to a surface of a substrate 1 on which electrodes 2 and 3 are arranged while passing therebetween.

In FIGS. 1A and 1B, reference numeral 1 denotes the substrate, 2 and 3 denote the electrodes, 4' denotes a carbon film, and 5 denotes a gap. 6 denotes a space between the carbon film and the substrate, which constitutes a part of the gap 5.

The above carbon film can be referred to as a "conductive film containing carbon as its main constituent", a "conductive film having a gap in its part and containing carbon as its main constituent which electrically connects between a pair of electrodes", or a "film obtained by performing the resistance reduction processing on the polymer film". Also, the carbon film may be simply referred to as a "conductive film".

In the electron-emitting device of the present invention thus structured, when an electric field is applied to the gap 5 sufficiently, electrons tunnel through the gap 5 to cause current (device current: If) to flow between the electrodes 2 and 3. The tunnel electrons partially become emitted electrons (Ie) by means of scattering.

In the electron-emitting device of the present invention, the gap 5 is arranged close to the vicinity of one electrode. In the case of W1<W2 as shown in FIG. 1A, the gap 5 is arranged substantially along the edges of the electrode 2. Then, as shown in, for example, FIG. 1B, the electrode 2 preferably has a surface exposed (existing) inside at least a part of the gap 5.

Note that the above-mentioned "exposure" in the present invention naturally includes a case in which the surface of the electrode 2 is completely exposed but does not exclude a state in which impurities, absorbates of gases in the atmosphere, or the like exist or deposit (is absorbed) on the surface of the electrode 2. In addition, the gap 5 may be formed by a "voltage application step" discussed later. In a case of forming the gap by the "voltage application step", the gap 5 is supposed to be formed by an interaction such as thermal deformation or a thermal distortion among an electrode, a carbon film and a substrate. Thus, in the present invention, the above-mentioned "exposure" includes even a state in which the residue of a carbon film or the like, which was in contact with the surface of the electrode 2 before the "voltage application step", slightly deposits on the surface of the electrode 2 in the gap 5 after undergoing the "voltage application step". In addition, if at least clear existence of a film is not confirmed on the surface of the electrode 2 in the gap 5 in a section TEM photograph (TEM photograph of a section including the gap 5 and the electrode 2) or an SEM photograph, this state also corresponds to "exposure" in the present invention.

When the gap 5 is formed with the above-mentioned structure, it is possible to make electrical conductance characteristics (electron-emitting characteristic) of an electron-emitting device extremely asymmetrical with respect to a polarity of a voltage to be applied between the electrodes 2 and 3. When a comparison is made between the case in which a voltage is applied in a certain polarity (normal polarity: a potential of the electrode 2 is made higher than a potential of the electrode 3) and the case in which a voltage is applied in an opposite polarity (reverse polarity), a difference in current value becomes as large as ten times or more if, for example, the voltage is 20V in both cases. This indicates that voltage-current characteristics of the electron-emitting device of the present invention are of a tunnel conduction type under a high electric field.

In addition, an extremely high electron-emitting efficiency is obtained in the electron-emitting device of the present invention described above. When this electron-emitting efficiency is to be measured, an anode electrode is arranged on the electron-emitting device and driven such that the electrode 2 on the side closer to the gap 5 has a higher potential than the electrode 3. In this way, the extremely high electron-emitting efficiency is obtained. If a ratio of a device current If flowing between the electrodes 2 and 3, to an emission current Ie captured by the anode electrode (Ie/If), is defined as an electron-emitting efficiency, its value becomes several times higher than that of a conventional surface conduction electron-emitting device formed by applying a "forming operation" and an "activation operation". As one of the reasons for this, the present inventors have surmised that the arrangement in which the electrode material is exposed in the gap 5 may contribute to such a high electron-emitting efficiency.

As will be described in detail later, the gap 5 can be formed by arranging a polymer film 4 so as to connect the pair of electrodes 2 and 3, applying resistance reduction processing to the polymer film 4, and performing a "voltage application step", in which a voltage is applied (a current is made to flow) to a film obtained by applying the resistance reduction processing (hereinafter referred to as "resistance-reduced polymer film", or "carbon film", or simply as "conductive film").

An example of a manufacturing method of the electron-emitting device of the present invention will be described with reference to FIGS. 1A and 1B and FIGS. 2A to 2D.

Figure 2A:
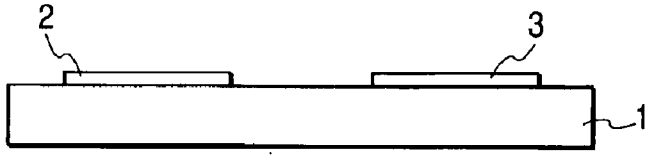
FIGS. 2A, 2B, 2C, and 2D are schematic sectional views showing an example of a manufacturing method of the electron-emitting device of the present invention.

(1) The substrate (base substrate) 1 consisting of glass or the like is sufficiently cleaned using a detergent, purified water, an organic solvent, and the like, and after depositing an electrode material by a vacuum evaporation method, a sputtering method, or the like, the electrodes 2 and 3 are formed on the substrate 1 using, for example, the photolithography technique (FIG. 2A). A distance between the electrode 2 and the electrode 3 is set to 1 μm or more and 100 μm or less. In addition, from the viewpoint of cost reduction, relatively inexpensive glass such as soda lime glass, low-alkali glass, or non-alkali glass is used as a member used in the substrate 1. The strain point of these inexpensive glasses are 700° C. or less.

Here, a general conductive material can be used as a material of the electrodes 2 and 3. Preferably, metal or a material containing metal as a main component is used as a material of the electrodes 2 and 3.

Figure 2B:
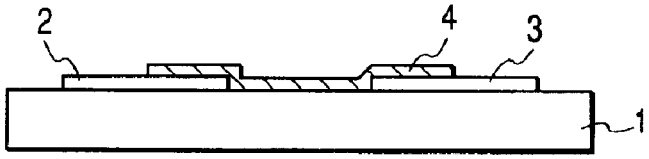

(2) Next, the polymer film (organic polymer film) 4 is formed on the substrate 1 having the electrodes 2 and 3 formed thereon so as to connect between the electrodes 2 and 3 (FIG. 2B).

As the film thickness of the polymer film, a thickness of 1 nm or larger and 1 μm or less is preferably selected from the viewpoints of the "resistance reduction processing" described later, the reproducibility of a film formed, and the like.

The term "polymer" in the present invention refers to one having at least a bond between carbon atoms. Preferably, molecular weight of the polymer of the present invention is 5000 or more, and more preferably 10000 or more.

When heat is applied onto the polymer having the bonds between carbon atoms, they may dissociate and recombine to thereby increase conductivity in some cases. As described above, the polymer whose conductivity is increased as a result of application of heat is called a "pyrolytic polymer".

In the present invention, the following polymer is also referred to as pyrolytic polymer. That is, the polymer which increases its conductivity by causing the bonds between carbon atoms to dissociate and recombine, in which dissociation and recombination caused due to factors other than heat, for example, electron beam or photon, occur together with those caused due to heat.

However, in the present invention, structural changes and changes in electroconductive characteristics of the polymer, which are caused due to heat or the factors other than heat are collectively referred to as "transformation".

The pyrolytic polymer may be considered to increase conductivity by increasing conjugated double bonds between carbon atoms in the polymer. The conductivity varies depending on a degree to which modification proceeds.

As a polymer easily expressing conductivity due to dissociation and recombination of the bonds between carbon atoms, that is, a polymer easily generating therein the double bonds between carbon atoms, aromatic organic polymers may be given as an example. Thus, in the present invention, it is preferable to use the aromatic polymers. Among those, in particular, aromatic polyimide is a polymer with which pyrolytic polymer having high conductivity at a relatively low temperature can be obtained. Therefore, aromatic polymers may be used as a more preferable material for the polymer in the present invention. In general, the aromatic polyimide is an insulator in itself but there are organic polymers such as polyphenylene oxadiazole and polyphenylene vinylene, which obtain conductivity before performing thermal decomposition. These polymers can also be preferably used in the present invention.

As a method of forming the polymer film 4, various known methods, i.e., a spin-coating method, a printing method, a dipping method, and the like can be used. In particular, the polymer film 4 can be formed at low cost by the printing method. Thus, it is a preferable method. Among those, the printing method of ink jet system is used, so that it is possible to dispense with a patterning step and to form a pattern of several hundreds of μm or less as well. Thus, it is also effective for manufacturing such an electron source as to be applied to a flat display panel, in which the electron-emitting devices are arranged at high density.

When forming the polymer film 4, a solution containing a polymer material may be used. In that case, the solution is applied onto the substrate 1 and then the solution is dried, to obtain the polymer film. As needed, however, a precursor solution of the polymer material may be also used for forming the polymer film 4. When the precursor solution of the polymer material is used to obtain the polymer film 4, the solution is applied onto the substrate 1 and then the substrate 1 is heated to remove a solvent and to change the precursor to the polymer.

According to the present invention, as described above, the aromatic polymers are preferably used as the polymer material. However, most of them is almost insoluble in a solvent, so that a method of using the precursor solution thereof is effective. As an example thereof, a polyamic acid solution as a precursor of aromatic polyimide is applied thereto to form a polyimide film by heating or the like, as described above.

Note that, for example, a solvent for dissolving the polymer precursor may be selected from the group consisting of N-methyl-pyrrolidone, N,N-dimethyl acetamide, N,N-dimethyl formamide, dimethyl sulfoxide, and so on. In addition, n-butyl cellosolve, triethanolamine, or the like may be used in combination with such a solvent. However, there is not imposed a particular limitation thereon as long as the present invention is applicable and the solvent is not limited to one of those listed above.

Note that, as shown in FIGS. 1A and 1B, in the case of, for example, forming the gap 5 on the electrode side, the polymer film 4 (or carbon film 4') may be formed such that a connection length of the electrode 2 and the polymer film 4 (or carbon film 4') and that of the electrode 3 and the polymer film 4 (or carbon film 4') are different depending on a shape of the polymer film 4 (or carbon film 4'). As an example thereof, as shown in, for example, FIGS. 1A and 1B, the polymer film 4 is formed such that the connection length (≅W1) of the electrode 2 and the polymer film 4 (or carbon film 4') and the connection length (≅W2) of the electrode 3 and the polymer film 4 (or carbon film 4') are different.

Note that the "connection length" (or "crossing length") in the present invention indicates "a length (boundary) over which the polymer film 4 (or the film 4' obtained by applying "resistance reduction processing" discussed later) and the electrodes (2, 3) are in contact with each other at edges of the electrodes (2, 3)". Alternatively, the "connection length" (or "crossing length") can be referred to as "a length of a part (boundary) that is formed by the electrodes (2, 3), the polymer film 4 (or the film 4' obtained by applying "resistance reduction processing" discussed later), and the substrate 1 coming into contact with each other."

The connection lengths can be made different from each other by using a method of performing patterning on the polymer film 4, for example, into a trapezoid shape as shown in FIGS. 1A, 1B, 2A to 2D. Alternatively, when the polymer film is formed by using a printing method of an ink jet system, the following method can be used for achieving the different lengths, in which droplets are applied close to one electrode by shifting the center position of the droplet. Further, apart from the above methods, after a surface energy on one electrode and that on the other electrode are made different, a polymer material solution or a precursor solution of the polymer material is applied, followed by heating to form the polymer films 4 having different connection lengths. In this way, as the method of achieving the different connection lengths, appropriate one can be selected from the various methods.

In the case in which the position of the gap 5 is controlled as described above in the present invention, the method of control is not limited to the above-mentioned method of making the connection lengths differ between the electrode 2 side and the electrode 3 side. A few of other methods will be described below.

(a) Make a connection resistance or a step coverage between the conductive film 4' and the electrode 2 and a connection resistance or a step coverage between the conductive film 4' and the electrode 3 asymmetrical with each other.

(b) Make degrees of diffusion of heat differ between the vicinity of an area where the conductive film 4' and the electrode 2 are connected and the vicinity of an area where the conductive film 4' and the electrode 3 are connected.

(c) Make the shapes of the electrodes 2 and 3 asymmetrical with each other.

(3) Subsequently, the "resistance reduction processing" (or "resistance reducing process") is performed so as to reduce resistance of the polymer film 4. The "resistance reduction processing" allows the polymer film 4 to express conductivity and turns the polymer film 4 into the conductive film 4'. In this "resistance reduction processing", the polymer film 4 can be reduced in resistivity by irradiating an energy beam (such as particle beams or light) to the film 4.

As an example of this "resistance reduction processing", the polymer film 4 can be reduced in resistance by heating the polymer, film 4. As the reason that the resistance of the polymer film 4 is reduced (i.e., the film is turned conductive) by heating, the film expresses conductivity by dissociating and recombining the bonds between carbon atoms in the polymer film 4.

The "resistance reduction processing" by heating can be attained by heating the polymer constituting the polymer film 4 at a temperature equal to or more than the decomposition temperature. In addition, it is particularly preferable to heat the above polymer film 4 in an anti-oxidizing atmosphere, for example, in an inert gas atmosphere or in a vacuum.

The aromatic polymer described above, especially aromatic polyimide, has a high thermal decomposition temperature, so that it may express high conductivity when it is heated at a temperature above the thermal decomposition temperature, typically 700° C. to 800° C. or more.

However, in the case of applying heat until the polymer film 4, which is a component constituting the electron-emitting device, is thermally decomposed, a method of heating the whole thereof using an oven, a hot plate, or the like may be restricted in views of heat resistance of other components constituting the electron-emitting device in many cases.

Figure 2C:
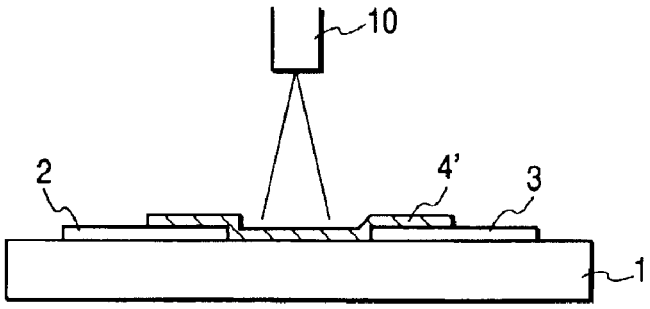

In view of the above, in the present invention, as shown in FIG. 2C, as a more suitable method for the resistance (resistivity) reduction processing, it is preferable to irradiate the polymer film 4 with a particle beam or a light beam by particle beam irradiation means 10 for irradiating an electron beam, an ion beam or the like, or by with light beam irradiation means 10 for irradiating a laser beam or the like, to thereby reduce the resistance (resistivity) of the polymer film 4. Thus, it becomes possible to reduce resistance (resistivity) of the polymer film 4 while preventing other components from being adversely affected by heat.

In order to supply the electron-emitting device, the electron source, and the image-forming apparatus of the present invention to users inexpensively and steadily, it is important to perform the above-mentioned "resistance reduction processing" steadily and at low cost.

For example, in the case in which an electron source or an image-forming apparatus of approximately 40 inches diagonally, one million or more electron-emitting devices of the present invention are arranged on a common substrate depending on a resolution. Thus, for example, if the number of substrates to be processing in one day, or the like is taken into account while considering the case in which the resistance reduction processing is performed for each electron-emitting device, time that can be spared for the "resistance reduction processing" inevitably becomes short.

According to examination by the inventors, when allowable time is reduced in irradiating energy beam (such as particle beams or light) in the "resistance reduction processing", a polymer film can not be sufficiently transformed as in the case in which the "resistance reduction processing" is performed over relatively long time. As a result, the inventors found that, in the "voltage application step" discussed later, the gap 5 could not be formed along the vicinity of one electrode or the interval of the gap 5 became too wide, so that the aforementioned high electron-emitting efficiency cannot be able to be realized in some cases. In a worse case, an electrode might be even broken down in the "voltage application step".

Then, the inventors found that requirements to be satisfied in the "resistance reduction processing" conducted over a sufficiently short irradiation time (more specifically ten seconds or less) and requirements to be satisfied in the "resistance reduction processing" conducted over an irradiation time longer than that are different significantly.

Figure 21:
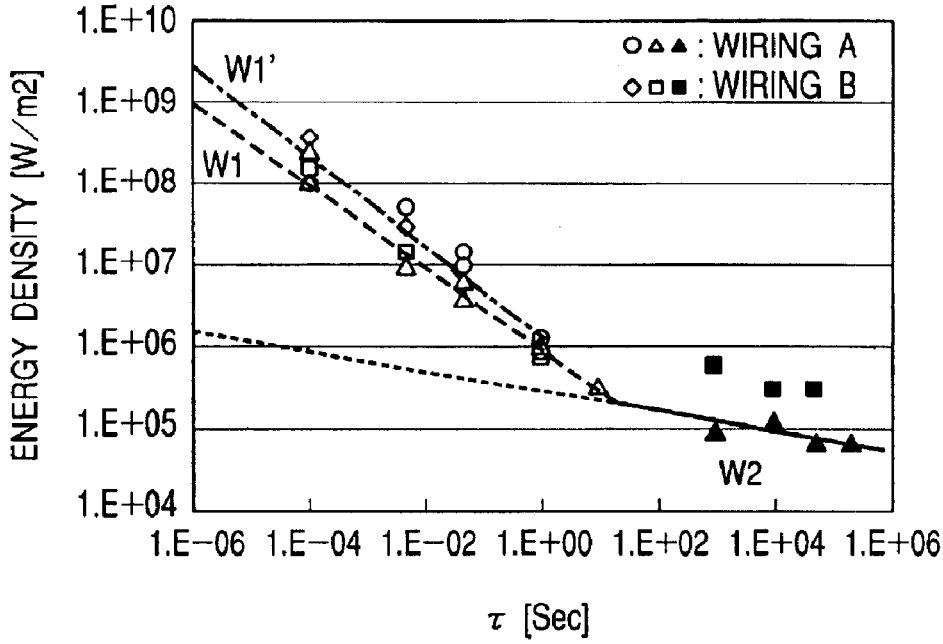
FIG. 21 is another schematic graph illustrating the step of resistivity reduction processing of the present invention.

In FIG. 21, an irradiation time is logarithmically indicated on the horizontal axis, and an energy density $W/m^2$ necessary for the "resistance reduction processing" of a polymer film is logarithmically indicated on the vertical axis. In FIG. 21, a broken line indicates a boundary above which satisfactory electron-emitting characteristics can be obtained in a region of ten seconds or less, and a solid line indicates a boundary above which satisfactory electron-emitting characteristics can be obtained in a region of ten seconds or more.

As shown in FIG. 21, it is seen that a relationship between the irradiation time and the irradiation energy density required for the "resistance reduction processing" of a polymer film changes largely with ten seconds as a boundary. It was found that, in an extended region (region of ten seconds or less, which is an extended area (indicated by a dotted line) of the solid line in FIG. 21) of a relation (a solid line in FIG. 21: W2) in an area where the "resistance reduction processing" was performed over a sufficiently long irradiation time (>ten seconds), sufficient resistance reduction cannot be performed, and as a result, excellent electron-emitting characteristics cannot be obtained. That is, the inventors found that, in a region of an irradiation time of ten seconds or less, when energy absorbed (given) for an unit time in an unit area of a polymer film is assumed to be $W(W/m^2)$, a sufficient "resistance reduction processing" could be performed only when W satisfies a condition of W1 defined by a formula (1) below (including the broken line in FIG. 21 as a boundary area), and as a result, an electron-emitting device of a structure shown in FIG. 1B which exhibits the aforementioned satisfactory electron-emitting characteristics can be obtained.

As a result of detailed examination, the inventors found that, in order to attain satisfactory electron-emitting characteristics, the energy absorbed (given) for the unit time in the unit area of a polymer film is required to satisfy the condition of W1 defined by the formula (1) below (including the broken line in FIG. 21 as a boundary area).

$$W1 \geqq 2T \times (\rho_{sub} \cdot C_{sub} \cdot \lambda_{sub}/\tau)^{1/2} \quad (1),$$

where T is defined as a temperature ° C. at which the polymer film is heated for one hour in a vacuum degree of $1\times10^{-4}$ Pa (or higher vacuum degree; because higher vacuum degrees such as $10^{-5}$ Pa will result in the substantially same resistivity reduction for the polymer film as that of $1\times10^{-4}$ Pa) to reduce a resistivity of the polymer film measured at a room temperature to 0.1 Ω·cm, $C_{sub}$ is a specific heat J/kg·K of the substrate, $\rho_{sub}$ is a specific gravity $kg/m^3$ of the substrate, $\lambda_{sub}$ is a thermal conductivity W/m·K of the substrate, and τ is an irradiation time of energy (particle beams or light) on a polymer film from the outside in the range of $10^{-9}$ sec to 10 sec.

In addition, the inventors found that, under the condition shown in the formula (1) above, in order to more easily manufacture an electron-emitting device that exhibits even more satisfactory electron-emitting characteristic, the energy absorbed (given) for the unit time in the unit area of a polymer film is required to satisfy a formula of W1' defined by the formula (2) below (including an alternate long and short dash line in FIG. 21 as a boundary area).

$$W1' \geqq A \times T \times (\rho_{sub} \cdot C_{sub} \cdot \lambda_{sub})^{1/2} \times \tau^{-\gamma} \quad (2),$$

where A indicates a constant and satisfies a condition $2.5 \leqq A \leqq 3.0$, γ is a constant and satisfies a condition $0.5<\gamma<0.6$, and is in the range of $1\times10^{-9}$ sec≦τ≦1 sec.

The resistivity can be found from a sheet resistance that is measured using a four-probe method and a film thickness that is measured by a film thickness interferometer such as a step meter or an ellipsometer, or the like.

In addition, the aforementioned resistance reduction step is characterized in that temperature dependency of a reaction speed, which involves heat absorption, generated in the aforementioned polymer film shows an Arrhenius type, and activation energy necessary for reducing a resistivity of the polymer film to 0.1 Ω·cm is 4 eV or less. This activation energy closely relates to T of the present invention.

In the case of the aforementioned aromatic polyimide, T is approximately 700° C., and the activation energy is about 3.2 eV.

Detailed consideration will be hereinafter made.

When it is assumed that energy absorbed by (given to) a polymer film in a unit area is E $J/m^2$, energy absorbed by (given to) the polymer film for a unit time in a unit area is $W(W/m^2)$, and an energy irradiation time is τ sec, E=W×τ=(heat absorption in the polymer film)+(heat diffusion to the substrate).

The film thickness of the polymer film 4 of the present invention is in the range of approximately 1 nm to 1 μm as described above, although it is not specifically limited. Therefore, since the film thickness of the polymer film is sufficiently small compared with the thickness of the substrate, it can be said that "the heat capacity of the polymer film is sufficiently small compared with the heat capacity of the substrate." Thus, at the time of energy irradiation, an amount of heat diffusion to the polymer film can be neglected, and it can be said that "temperature on the uppermost surface of the substrate is nearly equal to temperature of the polymer film."

In addition, the polymer film 4 expresses conductivity mainly by dissociation of combination and recombination among carbon atoms as described above (its resistivity is reduced). It is well known that dissociation of combination among carbon atoms involves an endothermic reaction. 300 to 400 kJ/mol is required for one C—C combination (combination of a carbon atom and a carbon atom), although it depends on a structure of a monomer. In the case of the present invention, the polymer film 4 has a film thickness of 1 nm or more and 1 μm or less as described above. Even in the case of the largest film thickness of 1 μm, a dissociation heat value per 1 $mm^2$ is considered to be on the order of several tens μJ at most, although it depends on a density of the polymer film. In the resistance reduction processing step of the polymer film 4, in order to reduce resistivity of the polymer film with high uniformity, it is necessary to irradiate it with an energy that is sufficiently larger than the above-mentioned dissociation heat value. In the formula (1) of the present invention, at least $10^{-9}$ sec≦τ is required as a condition for making the dissociation heat value sufficiently small as to be negligible compared with the energy to be irradiated. This condition can be considered a sufficient condition also in terms of convenience of the resistance reduction processing step. Consequently, since heat absorption of the polymer film can be neglected, it can be approximated that all heat values given by energy irradiation according to the present invention contribute to increase in temperature of the polymer film and the substrate.

On the other hand, there is known an experimental fact that heat diffusion to a substrate does not depend on a thickness of a wiring material or wiring but depends only on a substrate material when an irradiation time is short (details will be described in embodiments). Thus, it is considered that, in the case in which an irradiation time is short and a heat diffusion distance is sufficiently small compared with an energy irradiation diameter, the heat diffusion to the substrate can be modeled in one-dimension in a depth direction of the substrate.

When it is assumed that a specific heat of a substrate is $C_{sub}$ J/kg·K, a specific gravity of the substrate is $\rho_{sub}$ $kg/m^3$, and a thermal conductivity of the substrate is $\lambda_{sub}$ W/m·K, the following formula is established:

$$(\text{heat diffusion distance}) = 2\times((\lambda_{sub}\times\tau)/(c_{sub}\times\rho_{sub}))^{1/2}.$$

Therefore, a heat value given during τ sec (the heat diffusion to the substrate) can be expressed as follows:

$$(\text{heat diffusion to the substrate}) = \rho_{sub}\times c_{sub}\times\text{diffusion distance}\times(T-\text{room temperature}) \equiv \rho_{sub}\times c_{sub}\times\text{diffusion distance}\times T.$$

Thus, it is seen that energy $W_{sub}$ W/m$^2$ to be diffused to the substrate in a unit area and for a unit time is expressed as follows:

$$W_{sub}=2\times T\times(\rho_{sub}\cdot C_{sub}\cdot\lambda_{sub}/\tau)^{1/2}\ W/m^2,$$

which coincides with the formula (1) of the present invention.

According to further detailed examination by the inventors, it was found that, in some cases, in a film obtained by irradiating energy of the formula (1) on a polymer film, activation energy (Ea) with respect to electrical conduction was 0.3 eV or less but dispersion of the activation energy occurred (details will be described in Embodiment).

Further, it was found that the activation energy Ea can be produced more steadily by irradiating energy that satisfies the formula (1) and satisfies the formula (2) in the range of $1\times10^{-9}$ sec$\leqq\tau\leqq$1 sec.

Detailed consideration of the formula (2) will be hereinafter described.

Figure 26:
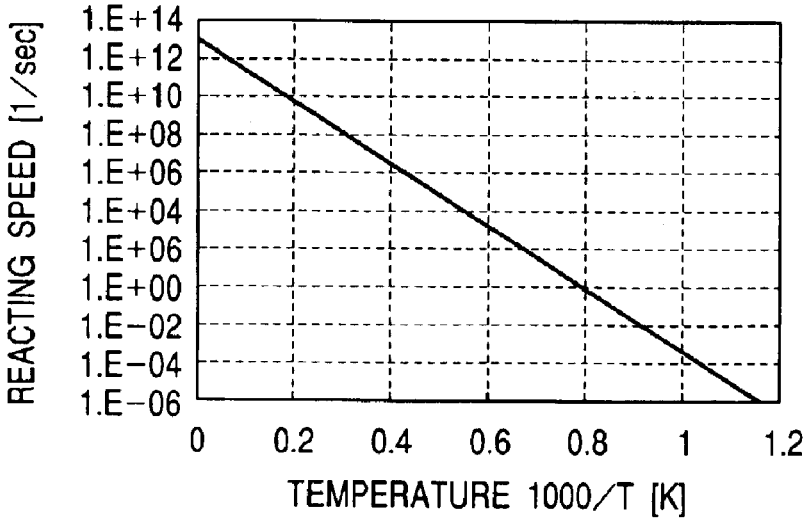
FIG. 26 is a schematic graph showing an example of temperature dependency of a reaction speed of resistance reduction of a polymer film of the present invention.

As described above, in the resistance reduction step, a polymer film involves an endothermic reaction mainly by dissociation of combination and recombination among carbon atoms. Temperature dependency of a speed of this reaction becomes an Arrhenius type, an example of which is shown in FIG. 26. This is represented by a formula as follows:

$$1/tr=A\times\exp(-Er/kTr) \quad (3)$$

Here, in the formula (3) above, A is an intercept of the Y axis (vertical axis) of a graph of FIG. 26 and indicates $10^{13}$ 1/sec that is a speed near molecular vibration, Tr indicates a reaction temperature K, tr indicates a reaction time sec, k indicates a Boltzmann constant, and Er indicates activation energy for reducing a resistivity of a polymer film to 0.1 Ω·cm. If it is assumed that a temperature, at which the polymer film is heated for one hour in a vacuum degree of $1\times10^{-4}$ Pa or more to reduce a resistivity of the polymer film measured at a room temperature to 0.1 Ω·cm, is T [K], $$Er=38.2\times k\times T \quad (4)$$

Thus, from the formula (3) and a formula (4), the following formula is obtained:

$$Tr=38.2/\{In(tr)+30\}\times T \quad (5)$$

In order to irradiate energy of power of W or more on the polymer film for the time τ to reduce resistance of the polymer film, temperature of the polymer film is required to be increased to Tr K indicated in a formula (5) at least within the time τ.

Thus, assuming that Tr=Tτ, tr=τ, and room temperature=300 K, from the formula (2) and the formula (5), the following formula (6) is obtained:

$$W\propto[38.2/\{In(tr)+30\}\times T-300]\times(\rho_{sub}I9\ c_{sub}\cdot\lambda_{sub}/\tau)^{1/2} \quad (6)$$

The first term of the formula (6) can be approximated to $A\times T\times\tau^{-\gamma'}$ ($\gamma'\equiv0.03$ to 0.1) in $1\times10^{-9}$ sec$\leqq\tau\leqq$1 sec.

Thus, it is seen that the formula (6) is changed to $W\propto A\times T\times\tau^{-\gamma'}\times(\rho_{sub}\cdot c_{sub}\cdot\lambda_{sub}/\tau)^{1/2}$, which coincides with formula (2) of the present invention obtained from the result of the experiment.

This means that, since the reaction speed of the polymer film cannot be negligible any more if τ becomes smaller than 1, although Ea≦0.3 eV is obtained with W1 obtained by the formula (1), it is preferable to further satisfy W1' of the formula (2) in order to obtain Ea in a stable manner.

In addition, in order to apply the "resistance reduction processing" to the polymer film 4 while continuing to suppress influence of heat to the substrate, it is preferable that energy irradiated from the outside is irradiated a plurality of times pulsatively.

In addition, according to the condition of energy irradiation of the present invention shown in the formula (1) above as indicated by the broken line of FIG. 21 or the condition of energy irradiation of the present invention shown in the formula (2) as indicated by the alternate long and short dash line of FIG. 21 which is a more progressively restrictive condition, in the case in which a large number of electron-emitting devices are arranged, the "resistance reduction processing" can be performed in a state in which a shape and a material of wiring arranged on the substrate for connecting each electron-emitting device do not affect the electron-emitting devices significantly. Thus, the "resistance reduction processing" can be applied to the large number of polymer films 4 with high uniformity. As a result, according to the present invention, an electron-emitting device having a characteristic of high uniformity can be arranged, and an image display apparatus with high uniformity of a displayed image can be formed.

In addition, from the formula (4), T increases when the activation energy Er of the polymer film 4 is large. Thus, from the formula (5), the actual reaction temperature Tr increases. In the present invention, energy is irradiated on the substrate partially from the outside, whereby a temperature for resistance reduction processing exceeding a heat resistance temperature (strain point or the like) of the substrate is realized in a polymer film portion. However, this is not allowed at the reaction temperature Tr that exceeds a melting point of the substrate greatly. Taking into account the actual melting point of the substrate, in order to set Tr to a realistic value that is not too high, it is preferable that the activation energy of the polymer film is 4 eV or less.

In addition, in the present invention, an upper limit of irradiation energy is not specifically restricted. However, considering realizability of an energy source, convenience in the "resistance reduction processing" step, a heat resistance temperature of an actual substrate, and the like, $3\times10^{12}$ W/m$^2$ is a realistic upper limit of irradiation energy at the maximum.

Further, the film (conductive film) 4' obtained by applying the "resistance reduction processing" to a polymer film exhibits a hole carrier conduction, and a resistivity of the film exhibits negative temperature characteristics (that is, the film 4' exhibits negative Temperature Coefficient of Resistance). In this case, activation energy (hereinafter referred to as Ea) of the film 4' obtained by applying the "resistance reduction processing" with respect to electrical conduction can be found from the temperature characteristics.

The Ea of the film 4' obtained by applying the "resistance reduction processing" to a polymer film and the resistivity thereof substantially have a correlation. With the above-described insufficient "resistance reduction processing", the Ea increases (the temperature characteristics become steep). As a result, thermal runaway occurs due to Joule heat generated in the "voltage application step". This means that temperature of the film obtained by applying the "resistance reduction processing" to a polymer film rises due to Joule heat in the "voltage application step". The resistivity of the film may further drop due to this temperature rise. Then, the Joule heat further increases due to the drop of the resistance, and the temperature of the film further rises. The inventors consider that this is because a desired gap 5 cannot be obtained as a result of occurrence of such a cycle.

As a result of earnest examination by the inventors of this invention, we found that, not only when the aforementioned "resistance reduction processing" is applied, but, if activation energy Ea of a conductive film (film obtained by applying the "resistance reduction processing" to a polymer film) before applying the "voltage application step" discussed later is 0.3 eV or less, the gap 5 can be arranged in the vicinity of one of the electrode 2 and the electrode 3 even if the connection length on the electrode 2 side and the connection length on the electrode 3 side are substantially equal (i.e., even if the electrode 2 and the electrode 3 are substantially the same). In addition, in the film 4' obtained by applying the "resistance reduction processing" to a polymer film of the present invention, if the "resistance reduction processing" is applied to the film such that its activation energy Ea drops to 0.3 eV or less, the gap 5 can also be arranged in the vicinity of one of the electrode 2 and the electrode 3 even if the connection length on the electrode 2 side and the connection length on the electrode 3 side are equal.

A method of measuring and calculating Ea of a film obtained by applying the "resistance reduction processing" to a polymer film with respect to electrical conduction will be hereinafter described.

Figure 3:
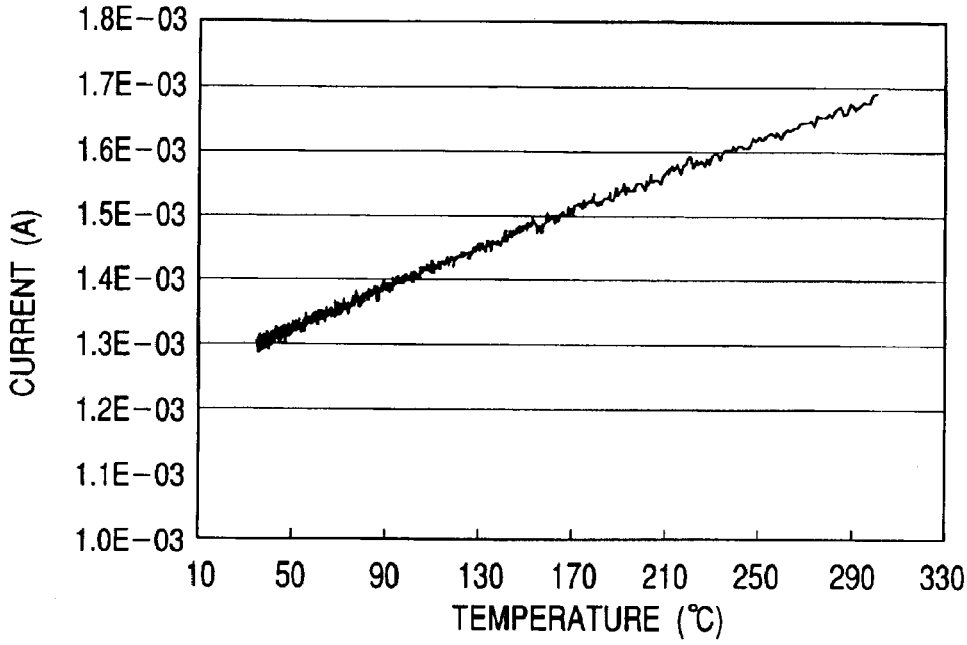
FIG. 3 is a graph showing an example of a relationship between a current flowing through a carbon film and a temperature in the present invention.
Figure 4:
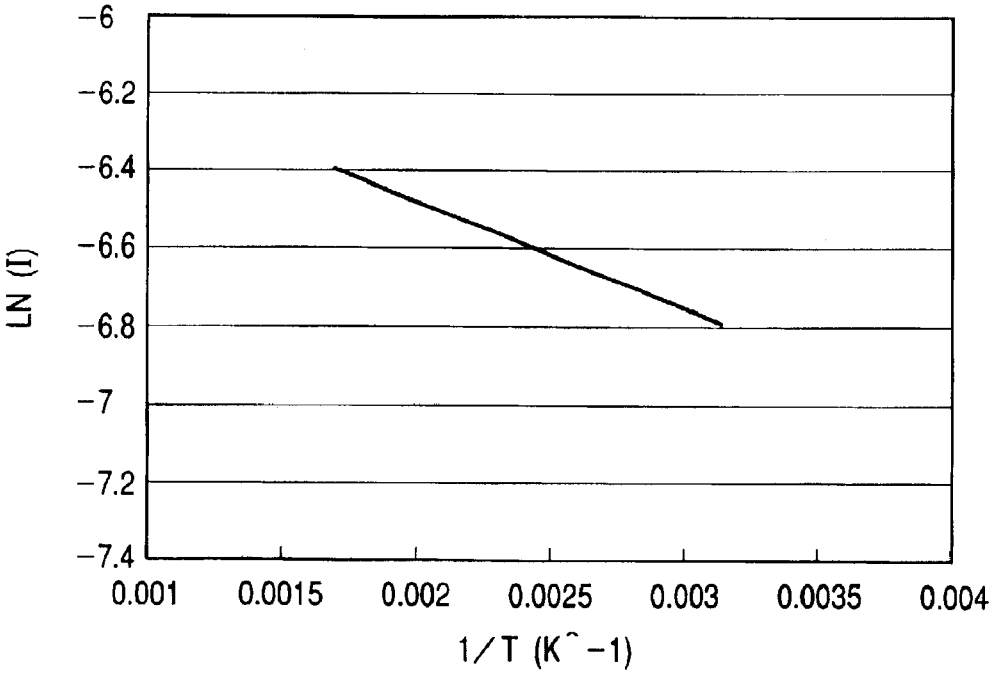
FIG. 4 is a graph showing an example in which a current flowing through the carbon film and a temperature are Arrhenius-plotted in the present invention.

For example, the substrate 1 is heated from the normal temperature to 300° C. using a heater (not shown) while applying a voltage (0.5 V) to the electrodes 2 and 3 under the vacuum on the order of $1\times10^{-6}$ Pa, and while monitoring a current flowing to the film obtained by applying the "resistance reduction processing" to a polymer film. An example of a current-temperature graph obtained as a result of the foregoing is shown in FIG. 3. Data of obtained current and temperature is Arrhenius-plotted ($I\propto\exp(-Ea/kT)$, I: electric current, k: Boltzmann constant, T: absolute temperature), and Ea can be calculated from an inclination of the plotted data. An example of Arrhenius plot is shown in FIG. 4.

An example of the "resistance reduction processing" of the present invention will be hereinafter described specifically.

(The case in which irradiation of electron beams is performed)

In the case in which electron beams are irradiated, the substrate 1 having the polymer film 4 formed thereon is set under the reduced pressure atmosphere (in a vacuum container) in which an electron gun is installed. Electron beams are irradiated on the polymer film 4 from the electron gun installed in the container. As a condition for irradiating electron beams in this case, it is preferable that an acceleration voltage $V_{ac}$ is 0.5 kV or more and 40 kV or less taking into account a penetration depth of electron beams into the polymer film 4 or the substrate 1.

A current density ($j_d$) is determined according to a heat conductivity, a specific heat and a specific gravity of the selected substrate 1, and $\tau$, which is arbitrarily selected in the range of $1\times10^{-9}$ seconds or more and 10 seconds or less, from the formula (1) of the present invention.

Usually, a current density ($j_d$) in the range of 0.01 mA/mm$^2$ or more and 10 mA/mm$^2$ or less is often used.

(The case in which irradiation of laser beams is performed)

In the case in which laser beams are irradiated, the substrate 1 having the polymer film 4 formed thereon is arranged on a stage, and laser beams are irradiated on the polymer film 4. In this case, as an environment for irradiating laser beams, it is desirable to perform the irradiation in an inert gas or in the vacuum in order to control oxidation (combustion) of the polymer film 4. However, it is possible to perform the irradiation in the atmosphere depending on a condition of irradiation of laser beams.

As a condition of irradiation of laser beams in this case, for example, it is preferable to irradiate laser beams using a semiconductor laser (790 to 830 nm).

Laser irradiation energy is determined according to a heat conductivity, a specific heat and a specific gravity of the selected substrate 1, and $\tau$, which is selected according to a melting point and a strain point of the substrate 1, from the formula (1) of the present invention. However, an output of a laser beam source is determined taking into account an irradiation area and an absorptance (=1−transmissivity−reflectance) of the polymer film 4 and the substrate 1 in a wavelength of the laser beams. Usually, the output of a laser beam source is often used in the range of several hundred mW/mm$^2$ to several tens W/mm$^2$.

In addition, the "conductive film" 4' formed by the above-mentioned "resistance reduction processing" is also referred to as "conductive film containing carbon as a main component" or simply as "carbon film".

In case of using catalytic metals such as Pt for electrodes 2 and 3, through the resistivity reduction processing, the thickness of the processed polymer film positioned on the electrodes becomes thinner than that of the processed polymer film positioned between the electrodes.

Figure 2D:
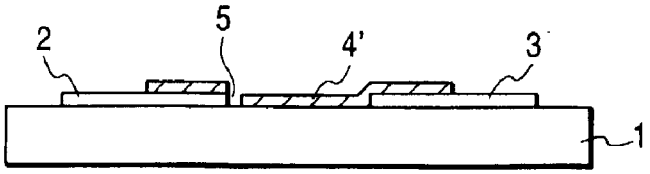

(4) Next, the gap 5 is formed in the conductive film 4' (FIG. 2D).

For example, the gap 5 is formed by applying voltage (flowing current) between the electrodes 2 and 3. Note that, the voltage to be applied is preferably a pulse voltage. Through this voltage application step, the gap 5 is formed in a part of the conductive film 4' (film 4' obtained by performing the resistance reduction processing on the polymer film). In order to drive the electron-emitting device at low voltage, the voltage to be applied in the above voltage application step is preferably pulse voltage.

Note that, the voltage application step may be also performed while continuously applying the voltage pulse between the electrodes 2 and 3 simultaneously with the above-mentioned resistance reduction processing. Further, in order to form the gap 5 with good reproducibility, gradually increasing the pulse voltage applied to the electrodes 2 and 3 is preferably performed.

Further, the voltage application step may be preferably performed under a reduced pressure atmosphere, more preferably under an atmosphere at a pressure of $1.3\times10^{-2}$ Pa or less.

Also, the voltage application step can be performed concurrently with the above-mentioned "resistance reduction processing".

Note that a resistance value of the film 4' obtained through the aforementioned "resistance reduction processing" may further drop in the above-mentioned "voltage application step". In the film 4' obtained by performing the "resistance reduction processing" and the carbon film 4' after the gap 5 is formed therein through the above-mentioned "voltage application step", a slight difference may occur in electric characteristics, film qualities, or the like thereof. However, in the present invention, these films 4' are not distinguished unless prescribed otherwise. More specifically, if there is no superiority difference in terms of crystallinity of carbon between a film, which has undergone the "resistance reduction processing" ("film obtained by applying the resistance reduction processing to a polymer film"), and a film, which has undergone the "voltage application step" ("carbon film"), the representation "carbon film" and the representation "film obtained by applying the resistance reduction processing to a polymer film" are representations for distinguishing process steps but are not representations for distinguishing film qualities.

Next, an example of a method of measuring and calculating Ea of the carbon film 4' after the gap 5 is formed therein through the above-mentioned voltage application step will be hereinafter described.

Figure 19:
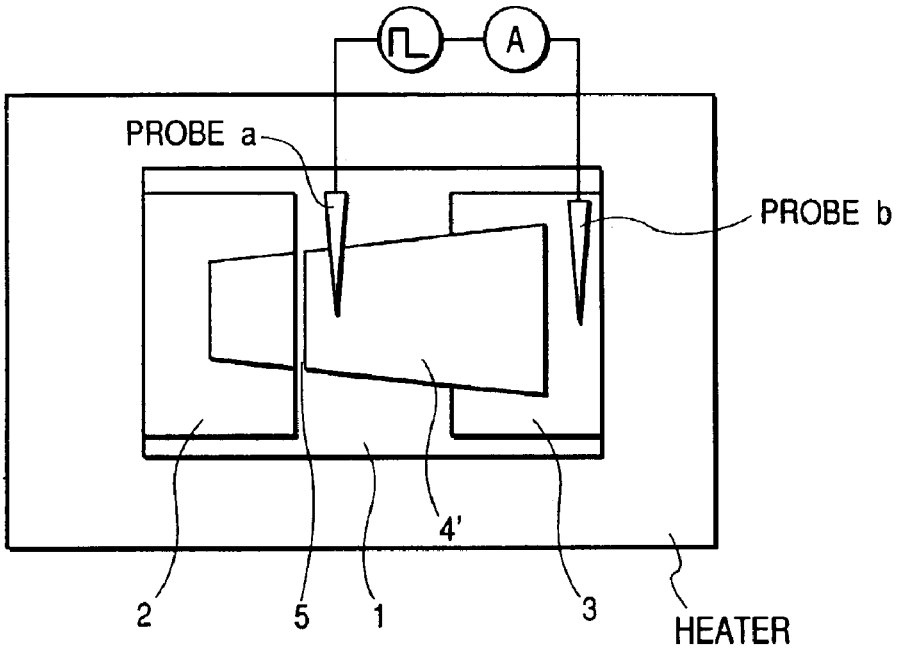
FIG. 19 is a schematic view showing a method of measuring temperature characteristics of an electrical conduction of a carbon film of the electron-emitting device of the present invention.

As shown in FIG. 19, a probe "a" is caused to contact the carbon film 4' between the electrodes 2 and 3 (contact position is arbitrary) and a probe "b" is caused to contact the electrode 3 under the vacuum in the order of $1\times10^{-6}$ Pa. Subsequently, the substrate 1 is heated from the normal temperature to 300° C. using a heater while applying a voltage (0.5 V) between both the probes and monitoring a current flowing to the carbon film 4'.

Obtained data of current and temperature is Arrhenius-plotted, and Ea can be calculated from an inclination of the plotted data.

Figure 5:
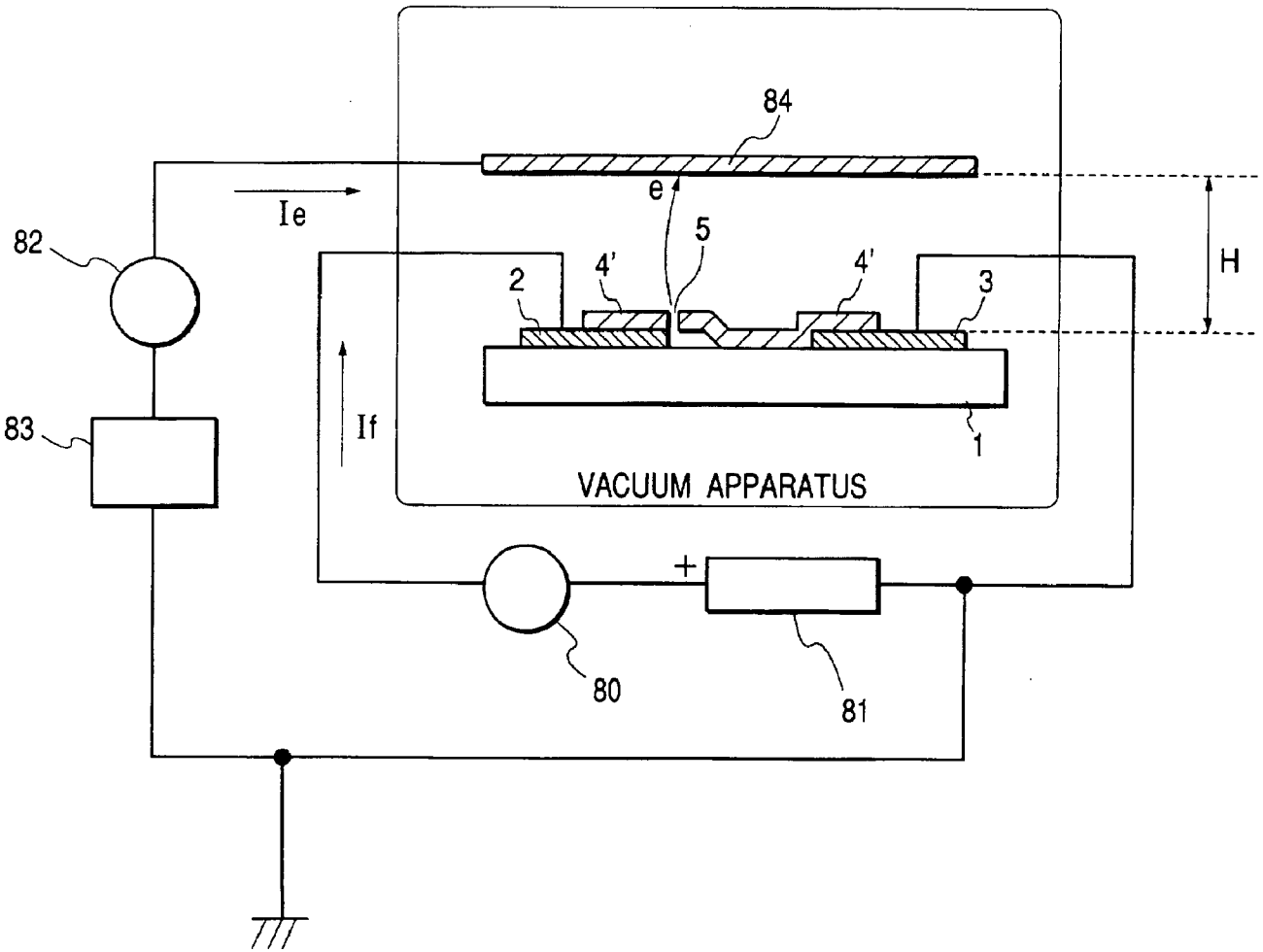
FIG. 5 is a schematic view showing an example of a vacuum apparatus provided with a measurement evaluating function.

The electron-emitting device obtained through the manufacturing method of the present invention described above is subjected to the measurement of voltage-current characteristics using a measurement apparatus shown in FIG. 5. The obtained characteristics of the device that exhibits satisfactory electron-emission are shown in FIG. 4. That is, the electron-emitting device has a threshold voltage Vth. Therefore, if a voltage lower than the threshold voltage Vth is applied between the electrodes 2 and 3, there is substantially no emission of electrons. However, if a voltage higher than the threshold voltage Vth is applied, an emission current (Ie) from the device and a device current (If) flowing between the electrodes 2 and 3 begin to develop.

Figure 15:
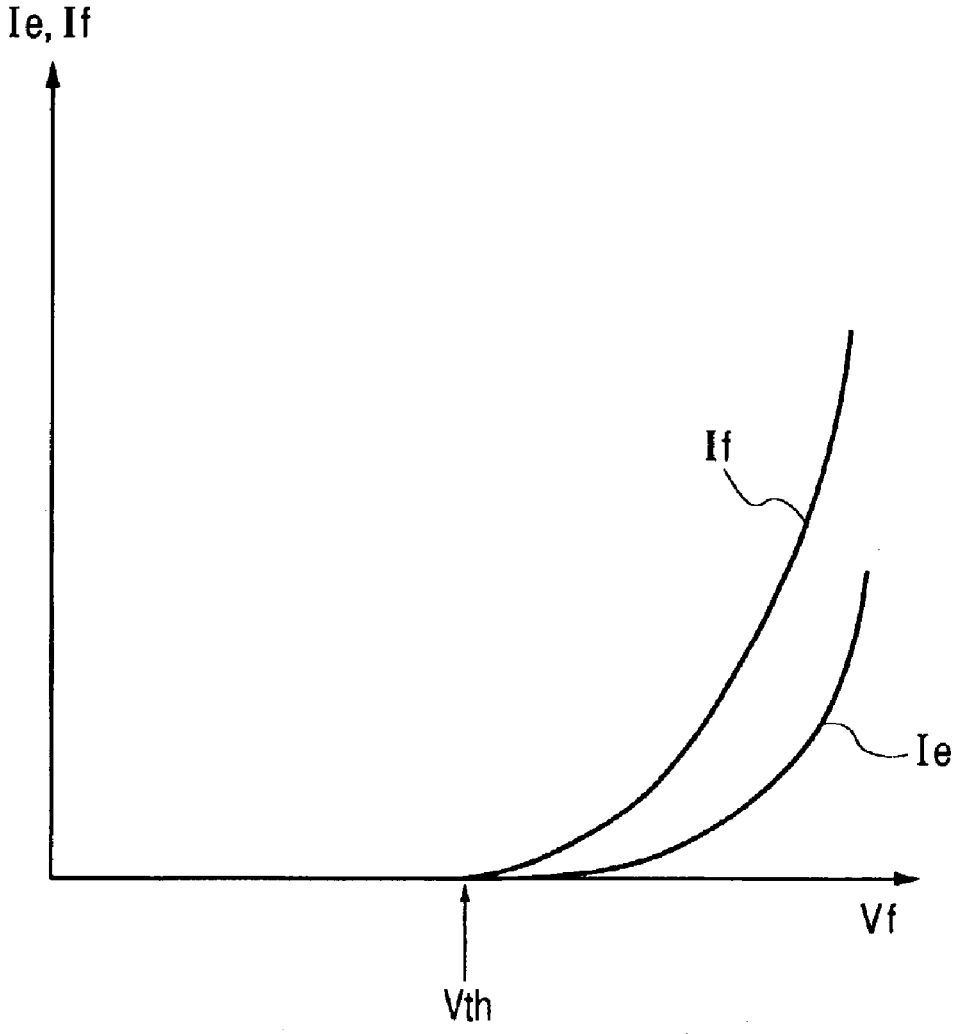
FIG. 15 is a schematic graph showing electron-emitting characteristics of an electron-emitting device according to the present invention.

In the present invention, if Ea of a film obtained by applying the resistance reduction processing to a polymer film is 0.3 eV or less, breakdown of a conductive film (film obtained by applying the resistance reduction processing to a polymer film) or breakdown of an electrode at the time of the "voltage application processing" can be suppressed, and an electron-emitting device showing satisfactory electron emission shown in FIG. 15 can be obtained (details are described in Embodiment).

Since the electron-emitting device has the above characteristics described above in FIG. 15, the electron source in which the plural electron-emitting devices are disposed in matrix on the same substrate can be formed. Therefore, it becomes possible to perform a passive matrix drive by selecting the desired device and driving the selected device. Note that, in FIG. 5, the same reference numerals as those used, for example, in FIGS. 1A and 1B denote the same members. Reference numeral 84 denotes an anode; 83, a high-voltage power supply; 82, an ampere meter for measuring an emission current Ie emitted from the electron-emitting device; 81, a power supply for applying a drive voltage Vf to the electron-emitting device; and 80, an ampere meter for measuring a device current If flowing between the electrodes 2 and 3. For measuring the device current If and the emission current Ie of the electron-emitting device, the power supply 81 and the ampere meter 80 are connected to the device electrodes 2 and 3, and the anode electrode 84 connected to the power supply 83 and the ampere meter 82 is arranged above the electron-emitting device. Also, this electron-emitting device and the anode electrode 84 are placed inside the vacuum apparatus. The vacuum apparatus is equipped with devices necessary for the vacuum apparatus, such as a vacuum pump and a vacuum gauge (not shown), so that the measurement and evaluation can be performed on this electron-emitting device under a desired vacuum condition. Note that, a distance H between the anode electrode and the electron-emitting device is set to 2 mm and the pressure inside the vacuum apparatus is set to $1\times10^{-6}$ Pa.

(5) Stabilization Drive

Figure 18:
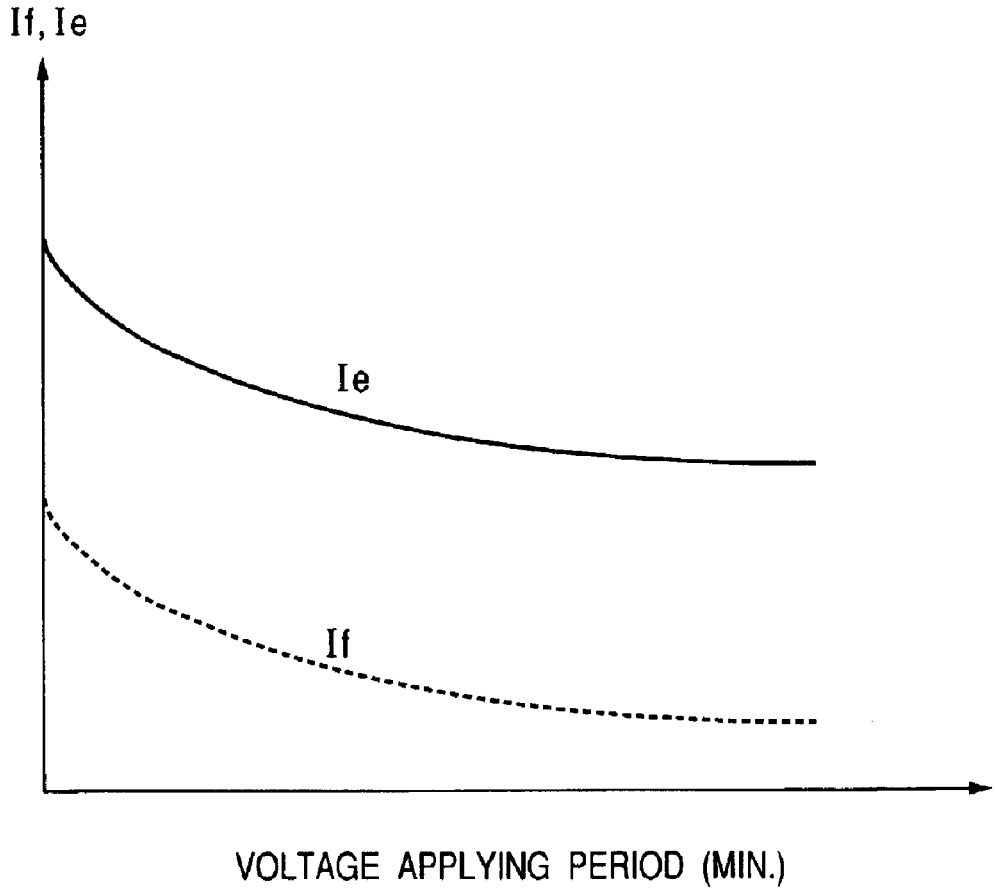
FIG. 18 is a schematic graph for illustrating a part of a manufacturing process of the image-forming apparatus of the present invention.

Next, a desired voltage is preferably applied to the electron-emitting device obtained in the aforementioned step to perform stabilization of electron-emitting characteristics. As a result of earnest examination of the inventors of the present invention, we found that, when the electron-emitting device of the present invention is driven after the gap 5 is formed, decrease in an emission current and a device current in the initial period of the drive occurs. This situation is shown in FIG. 18. As shown in the figure, although decrease in the current occurs in the initial period of the drive, this decrease ends by performing device drive for a certain period of time, and stable electron emission is continued thereafter without causing such variation. This drive for stabilizing an emission current and a device current is referred to as stabilization drive here.

Time required for this stabilization drive varies depending on a width of a voltage pulse to be applied, a peak value of the voltage pulse, and a pulse interval but is generally in the range of several minutes to several hundred minutes. If a period of the stabilization drive is fixed, the longer the pulse width, or if the drive pulse width is fixed, the shorter the pulse interval or the higher the peak value, the shorter the required time becomes. This indicates that the higher a drive duty (i.e., pulse width/pulse period) of the stabilization drive, in shorter time the stabilization can be performed.

Figure 24:
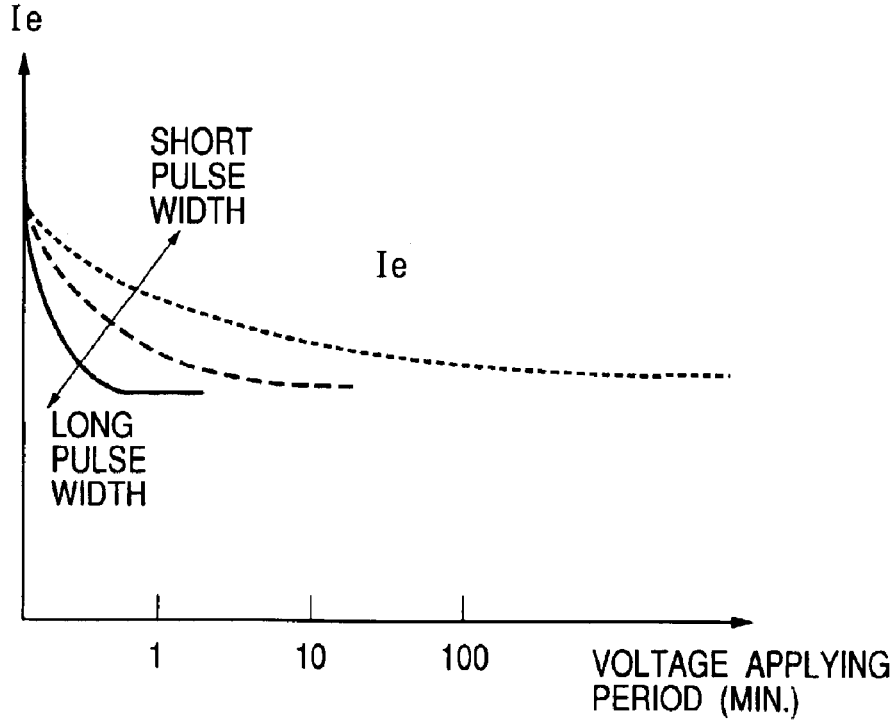
FIG. 24 is a schematic graph showing an example of stabilization drive of the electron-emitting device according to the present invention.
Figure 25:
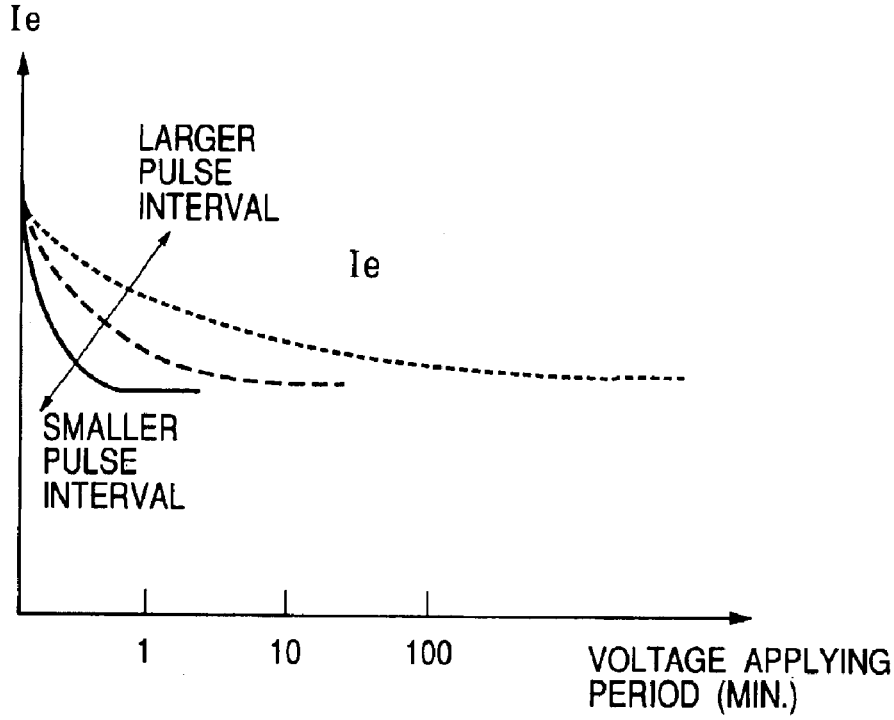
FIG. 25 is a schematic graph showing an example of the stabilization drive of the electron-emitting device according to the present invention.

This situation is shown in FIGS. 24 and 25. FIG. 24 schematically shows a situation of stabilization in the case in which the pulse width is changed, and FIG. 25 schematically shows a situation of stabilization in the case in which the pulse interval is changed. This behavior is the same in the pulse peak value, and the higher the peak value, the shorter the time required for the stabilization. Note that, although only the emission current is described in the figures for simplification of the description, it is known that the device current shows the same change, and the stabilization drive can be performed while keeping an electron-emitting efficiency (value of Ie/value of If) high during the stabilization drive.

Note that, in the case in which the peak value of the pulse voltage used for the stabilization drive is high, the peak value is not preferable because it is likely to cause breakdown of the device. The peak value in the order of slightly exceeding a voltage applied at the time of actual drive is considered to be an upper limit. More specifically, the peak value is preferably 0.7 times or more and 1.5 times or less, and more preferably 1.05 times or more and 1.2 times or less of a maximum voltage applied to the device at the time of actual drive.

However, since the stabilization drive requires that a current be flown and a function of stabilization cannot be expressed with an extremely low voltage at which the device current is not observed, a certain degree of voltage is required. More specifically, a voltage of Vth or more at which the emission current Ie and the device current If start to flow as shown in FIG. 15 is required.

Note that, in the present invention, the "actual drive" indicates drive after the electron-emitting device, the electron source or the image display apparatus of the present invention is shipped from a manufacturer. For example, it indicates drive within a range assumed in advance that is applied to a device when an image desired by a user such as a VTR image or a TV image is displayed. It is different from a condition of drive that is applied to the device unexpectedly due to some trouble.

In addition, it is possible to continue to perform this step of stabilization drive in the aforementioned gap forming step. The step can be continuously performed by applying stabilization drive voltage to the electrodes 2 and 3 after continuously applying a voltage pulse to the electrodes 2 and 3 to form a gap. In both the cases, the stabilization drive step is desirably performed under the reduced pressure atmosphere, preferably in the atmosphere of a pressure of $1.3\times10^{-3}$ Pa or less.

If the electron-emitting device is panelized as an image-forming apparatus, a panelization process (seal-bonding step) is required as described later. However, since the above-mentioned step of stabilization drive is a step for determining characteristics of the electron-emitting device, it is desirable that the process is performed in a depressurized panel after having undergone the panelization process (seal-bonding step), and it is more desirable that the electron-emitting device is not subjected to a heating step after the stabilization drive.

The various conditions of the stabilization drive described above should be set in view of actual characteristics of the electron-emitting device or the image-forming apparatus, and the present invention is not limited the above-mentioned conditions.

Next, the image-forming apparatus in the present invention using the above-mentioned electron-emitting device will be described.

Figure 16:
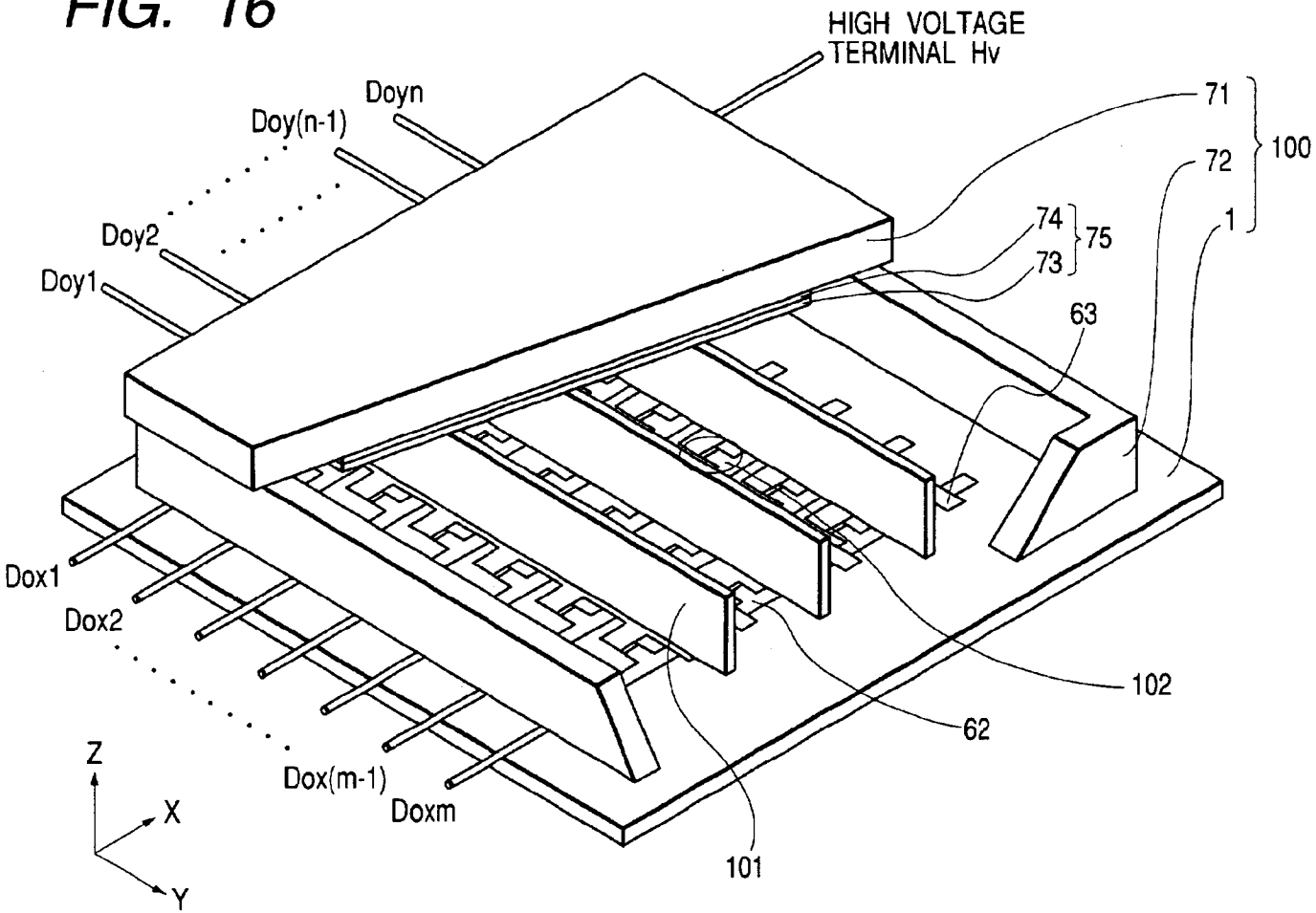
FIG. 16 is a schematic perspective view of an image-forming apparatus of the present invention.

FIG. 16 is a schematic diagram showing an example of an image-forming apparatus using an electron-emitting device 102 manufactured in accordance with the manufacturing method of the present invention. Note that FIG. 16 is a diagram in which parts of a supporting frame 72 and a face plate 71, which are described below, are removed in order to explain the inside of the image-forming apparatus (airtight container 100). Further, a driver circuit is not shown.

In FIG. 16, reference numeral 1 denotes a substrate on which a large number of electron-emitting devices 102 are arranged. In explanation of the image-forming apparatus, it is mentioned as rear plate. Reference numeral 71 denotes the face plate provided with an image-forming member 75. Reference numeral 72 denotes the supporting frame for keeping the space between the face plate 71 and the rear plate 1 in a reduced pressure state. Reference numeral 101 denotes a spacer arranged for keeping an interval between the face plate 71 and the rear plate 1.

In the case where the image-forming apparatus 100 is a display (image display apparatus), the image-forming member 75 is constituted by a phosphor film 74 and a conductive metal back 73 such as a metal back. Reference numerals 62 and 63 denote wirings respectively connected to the electron-emitting devices 102 for applying a voltage thereto. Doy1 to Doyn and Dox1 to Doxm denote drawing wirings for connecting the driver circuit or the like arranged outside of the image-forming apparatus 100 with end portions of the wirings 62 and 63 led to the outside from the reduced pressure space (space surrounded by the face plate, the rear plate, and the supporting frame) of the image-forming apparatus.

Next, examples of methods of manufacturing an image-forming apparatus according to the present invention are described below with reference to FIGS. 6 to 12 and the like.

(A) At first, a rear plate 1 is prepared. The rear plate 1 made of an insulating material is used, and particularly, the rear plate 1 made of glass is preferably used.

Figure 6:
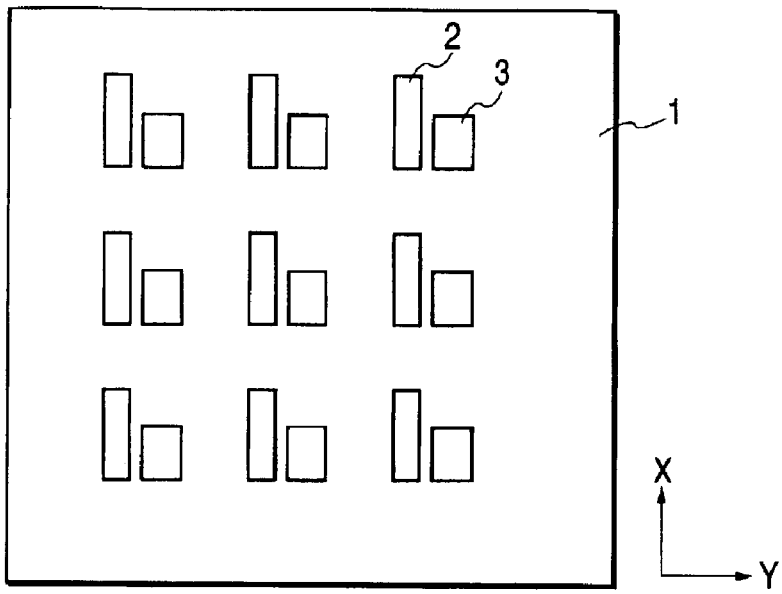
FIG. 6 is a schematic view showing an example of a manufacturing process for an electron source of a passive matrix arrangement of the present invention.

(B) Next, a plurality of pairs of electrodes 2 and 3 shown in FIGS. 1A and 1B are formed on the rear plate 1 (FIG. 6). An electrode material may be a conductive material. Further, the electrodes 2 and 3 can be formed by one of various methods such as a sputtering method, a CVD method, and a printing method. Note that, in FIG. 6, for simplifying the explanation, there is shown an example in which nine pairs of electrodes in total, i.e., three pairs of electrodes in an X direction and three pairs of electrodes in a Y direction, are formed. However, the number of the pairs of electrodes is appropriately defined depending on the resolution of the image-forming apparatus.

Figure 7:
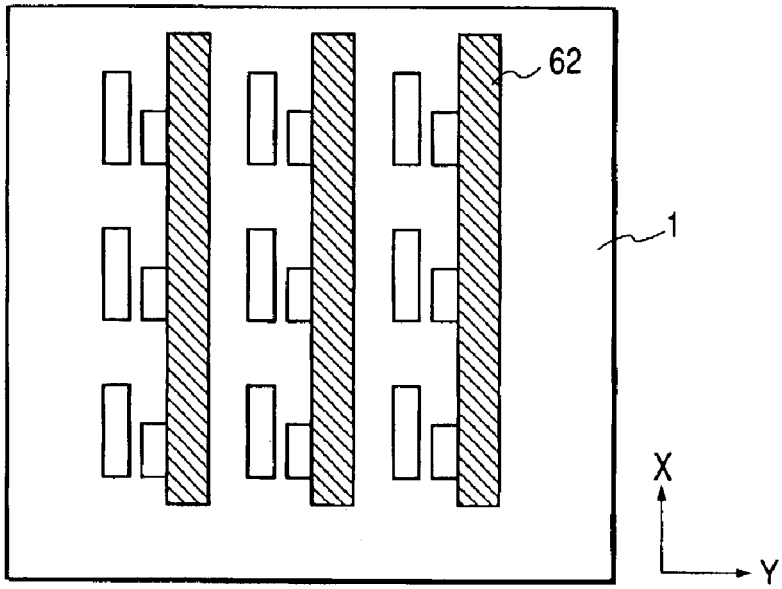
FIG. 7 is a schematic view showing an example of the manufacturing process for the electron source of a passive matrix arrangement of the present invention.

(C) Subsequently, a lower wiring 62 is formed so as to cover a part of the electrode 3 (FIG. 7). Various methods can be employed for a method of forming the lower wiring 62. Preferably, a printing method is employed. Among printing methods, a screen printing method is preferable in the point that a large-area substrate can be formed at low cost.

Figure 8:
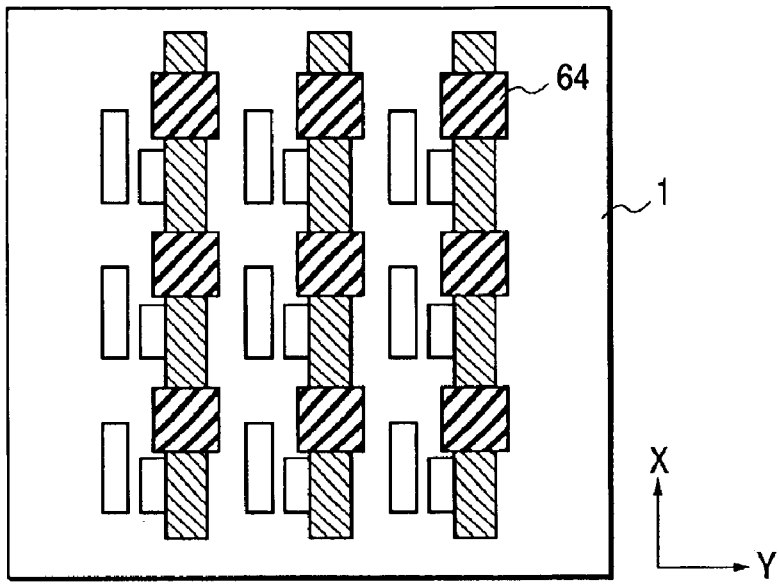
FIG. 8 is a schematic view showing an example of the manufacturing process for the electron source of a passive matrix arrangement of the present invention.

(D) An insulating layer 64 is formed at an intersecting portion of the lower wiring 62 and an upper wiring 63 to be formed in the next step (FIG. 8). Various methods can also be employed for a method of forming the insulating layer 64. Preferably, a printing method is employed. Among printing methods, a screen printing method is preferable in the point that a large-area substrate can be formed at low cost.

Figure 9:
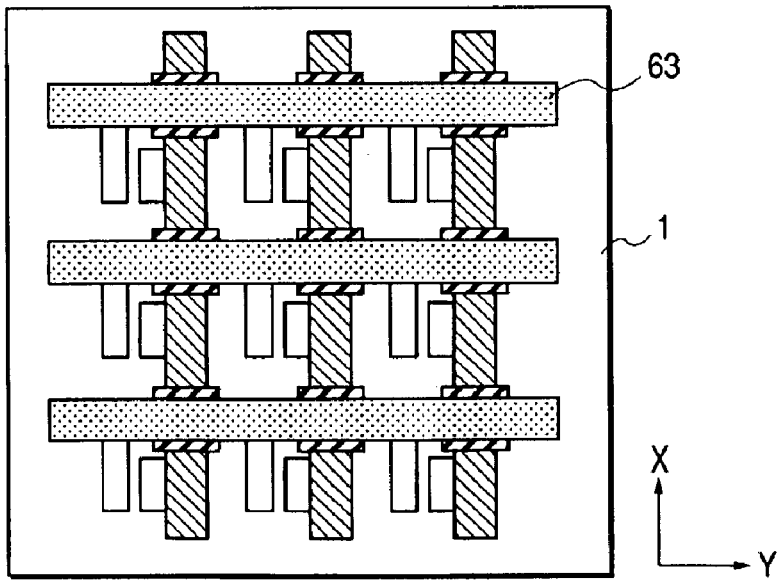
FIG. 9 is a schematic view showing an example of the manufacturing process for the electron source of a passive matrix arrangement of the present invention.

(E) The upper wiring 63 substantially orthogonal to the lower wiring 62 is formed (FIG. 9). Various methods can also be employed for a method of forming the upper wiring 63. Preferably, a printing method is employed similarly to the lower wiring 62. Among printing methods, a screen printing method is preferable in the point that a large-area substrate can be formed at low cost.

Figure 10:
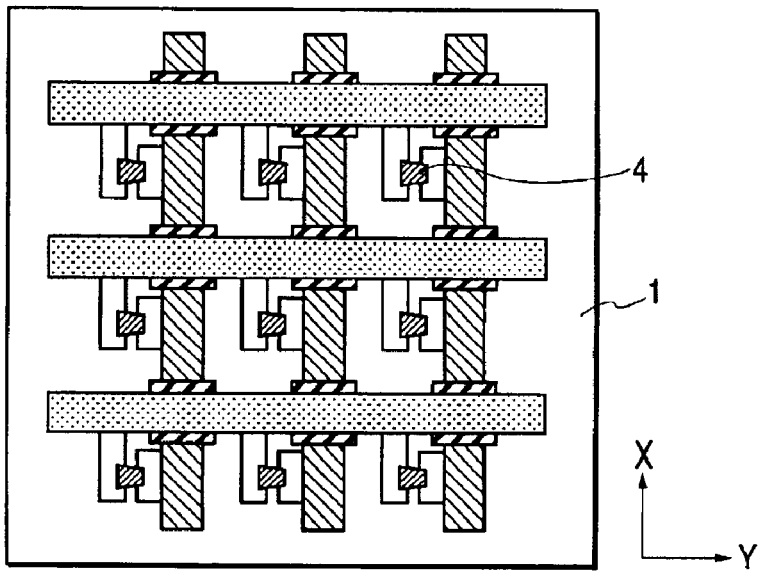
FIG. 10 is a schematic view showing an example of the manufacturing process for the electron source of a passive matrix arrangement of the present invention.

(F) Next, a polymer film 4 is formed to connect between the pair of electrodes 2 and 3 (FIG. 10). The polymer film 4 can be formed by various methods as described above. However, in order to simply form the polymer film 4 in a large area, an inkjet method may be used, or the polymer film may be patterned into a desired shape as described above.

Figure 11:
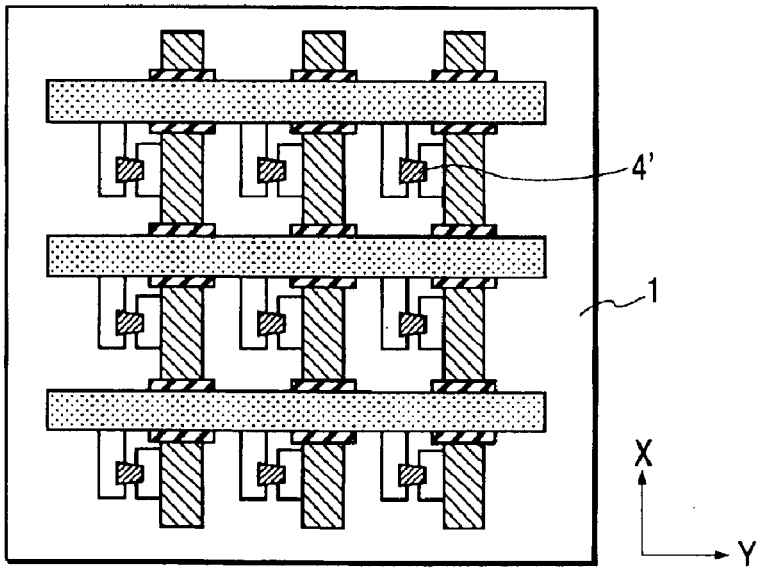
FIG. 11 is a schematic view showing an example of the manufacturing process for the electron source of a passive matrix arrangement of the present invention.

(G) Subsequently, the "resistance reduction process" for subjecting the polymer film 4 to resistance lowering is performed as described above. The "resistance reduction process" to the polymer film 4 is performed by conducting irradiation with a particle beam such as an electron beam and an ion beam as described above, or a laser beam. The "resistance reduction process" is performed preferably in a reduced pressure atmosphere. Through the step, the polymer film 4 is imparted with conductivity to be changed into the conductive film (carbon film) 4' (FIG. 11).

Figure 12:
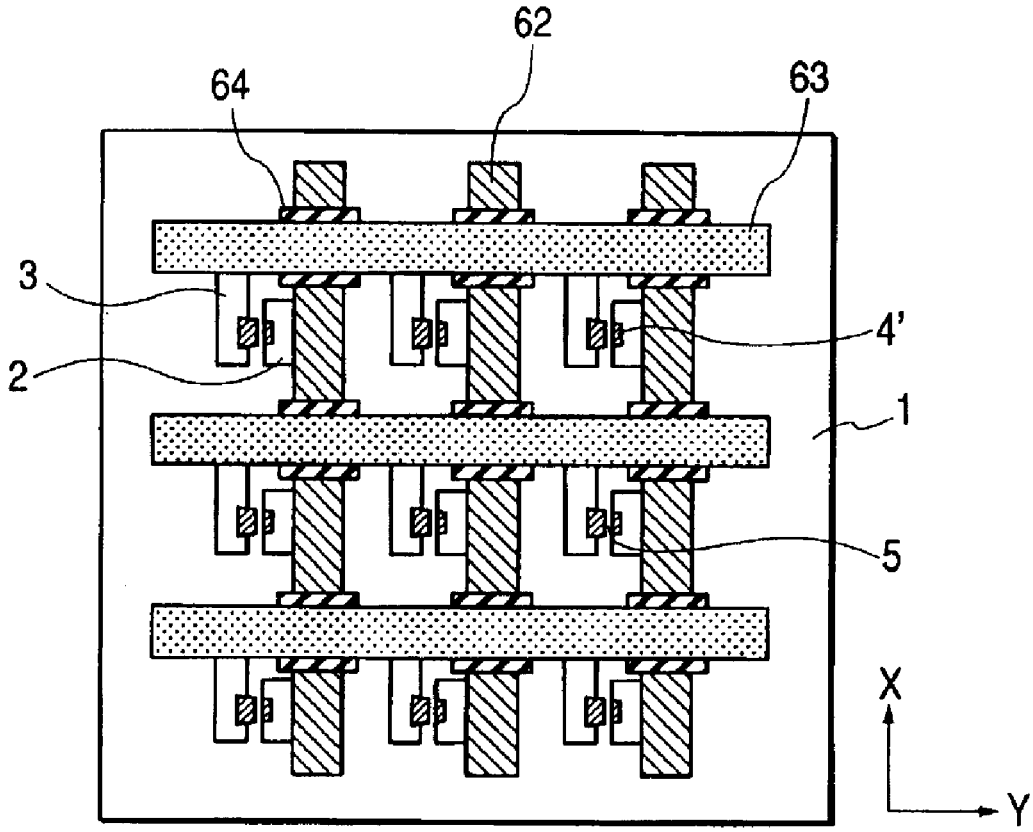
FIG. 12 is a schematic view showing an example of the manufacturing process for the electron source of a passive matrix arrangement of the present invention.
Figure 13A:
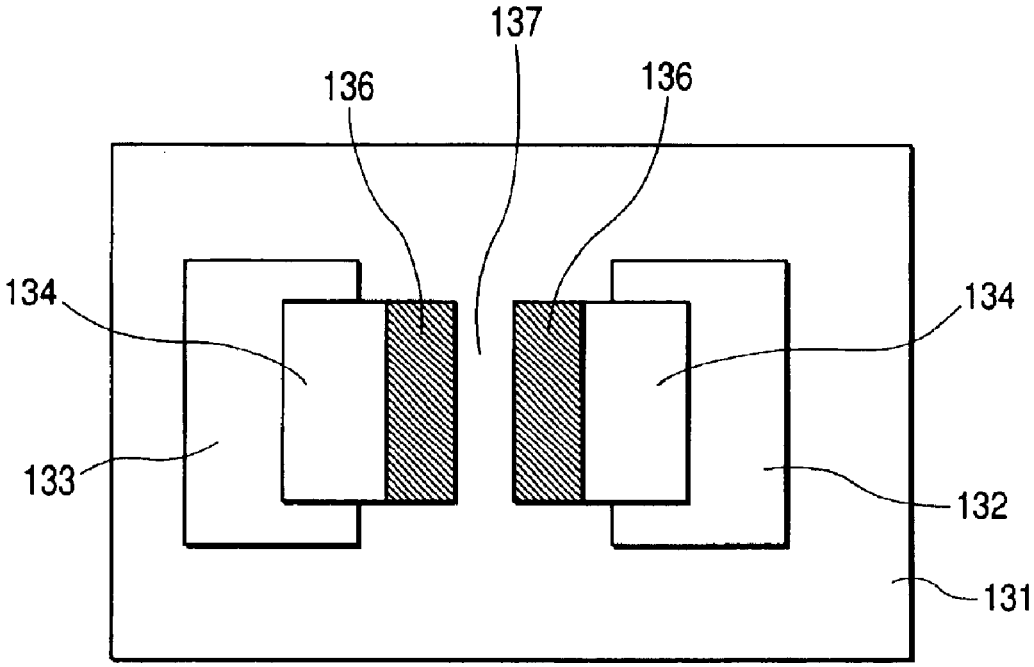
FIG. 13A PRIOR ART
FIGS. 13A and 13B are schematic views of a conventional electron-emitting device.
Figure 13B:
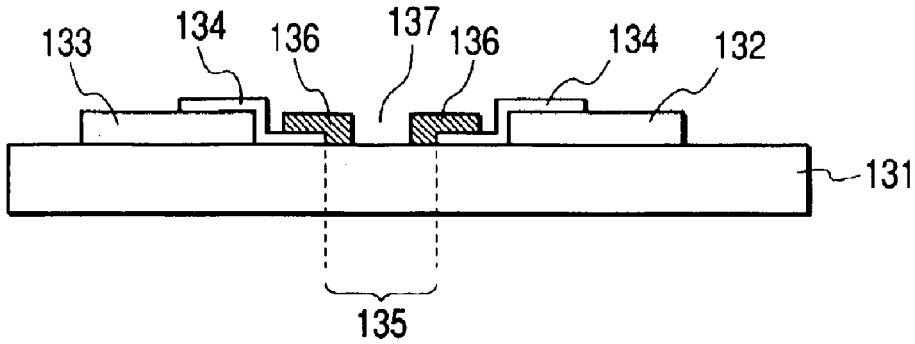
FIG. 13B PRIOR ART
Figure 14A:
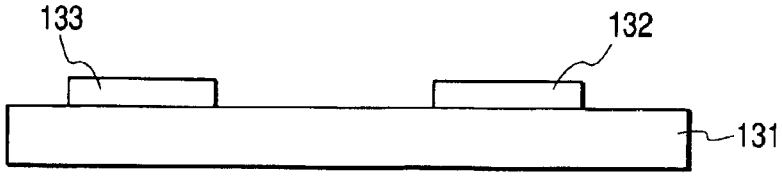
FIG. 14A PRIOR ART
FIGS. 14A, 14B, 14C, and 14D are schematic views of a manufacturing process for the conventional electron emitting-device.
Figure 14B:
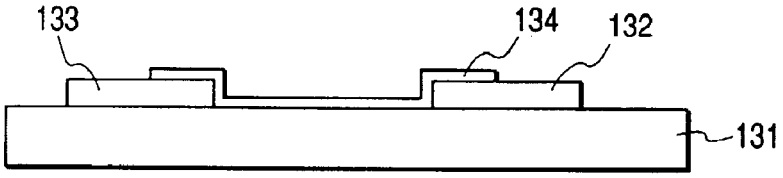
FIG. 14B PRIOR ART
Figure 14C:
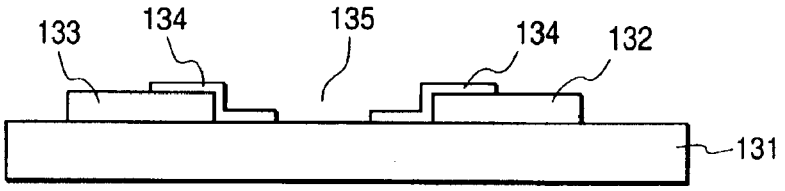
FIG. 14C PRIOR ART
Figure 14D:
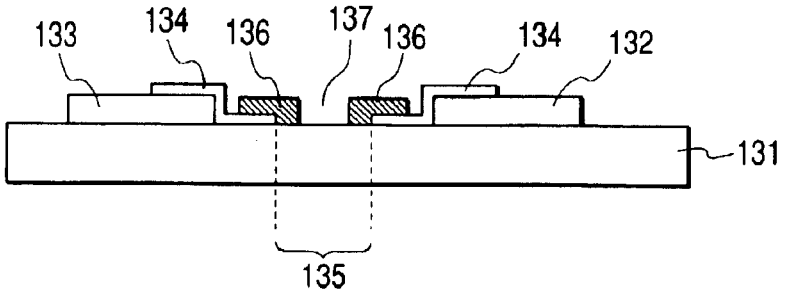
FIG. 14D PRIOR ART

(H) Next, a gap 5 is formed in the conductive film 6 obtained by the step (G). Note that the voltage to be applied is preferably a pulse voltage. The gap 5 can be formed by applying a voltage to the respective wirings 62 and 63. Thus, a voltage is applied between the pair of electrodes 2 and 3. The gap 5 is formed in a part of the conductive film 4' by the voltage application step (FIG. 12). The gap 5 is arranged in the vicinity of one of the electrodes.

The voltage application step may also be performed by successively applying voltage pulses between the electrodes 2 and 3 while the above resistance reduction process is simultaneously performed, that is, during electron beam or laser beam irradiation. In any case, the voltage application step is desirably performed under a reduced pressure atmosphere.

Figure 17A:
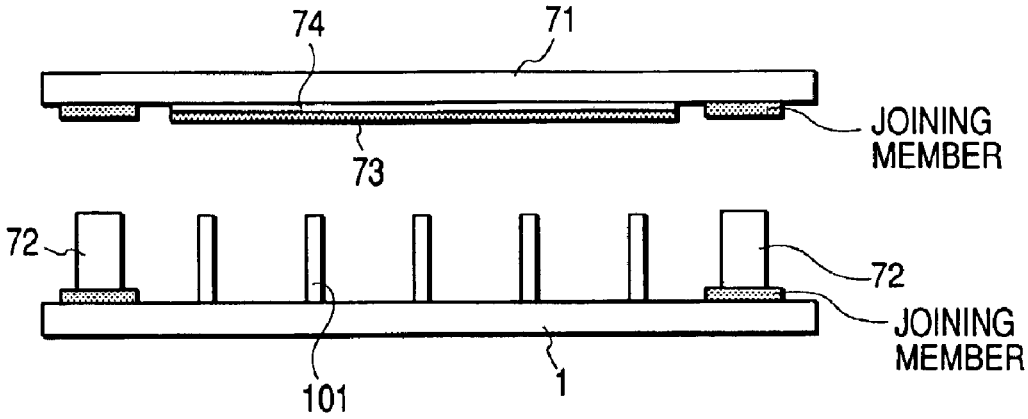
FIGS. 17A and 17B are schematic views showing an example of stabilization drive of the electron-emitting device according to the present invention.

(I) Next, a face plate 71 having a metal back 73 made of an aluminum film and a phosphor film 74, which is prepared in advance, and the rear plate 1 that has undergone the preceding steps (A) to (H) are aligned such that the metal back faces the electron-emitting devices (FIG. 17A). In addition, a joining member is arranged on a contact surface (contact area) between a supporting frame 72 and the face plate 71. Similarly, another joining member is arranged on a contact surface (contact area) between the rear plate 1 and the supporting frame 72. The above joining member to be used is one having the function of retaining vacuum and the function of adherence. Specifically, frit glass, indium, indium alloy, or the like is used for the joining member.

In FIG. 17A, there is shown an example in which the supporting frame 72 is fixed (adhered) by means of the joining member onto the rear plate 1 that has undergone the preceding steps (A) to (H). According to the present invention, however, there is no need to always bond the supporting frame 72 to the rear plate 1 at the time of performing the step (I). In FIG. 17A, similarly, there is shown an example in which a spacer 101 is fixed onto the rear plate 1. According to the present invention, however, there is no need to always fix the spacer 101 onto the rear plate 1 at the time of performing the step (I).

Further, in FIG. 17A, there is shown an example in which the rear plate 1 is arranged on the lower side while the face plate 71 is arranged on the upper side of the rear plate 1 for the sake of convenience. However, there is no problem as to which one is on the upper side.

Furthermore, in FIG. 17A, there is shown an example in which the supporting frame 72 and the spacer 101 are previously fixed (adhered) onto the rear plate 1. However, they may only be mounted on the rear plate or face plate so as to be fixed (adhered) onto the plate in the subsequent "seal-bonding step".

Figure 17B:
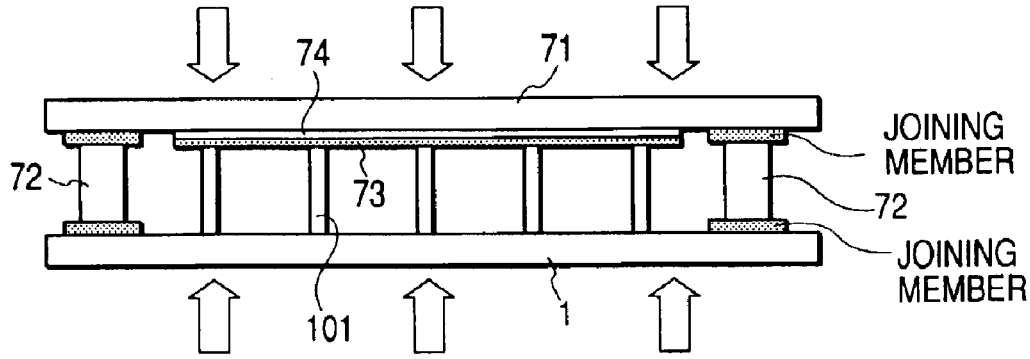

(J) Next, the seal-bonding step is performed. The face plate 71 and the rear plate 1, which have been arranged to face each other in the above step (I), are pressurized in the direction in which they face each other while at least the joining member is heated (FIG. 17B). It is preferable to heat the whole surfaces of the face plate and the rear plate in order to decrease thermal distortion.

In the present invention, the above "seal-bonding step" may be preferably performed in a reduced pressure (vacuum) atmosphere or in a non-oxidative atmosphere. Specifically, the reduced pressure (vacuum) atmosphere is preferably at a pressure of $10^{-5}$ Pa or less, more preferably $10^{-6}$ Pa or less.

This seal-bonding step allows the contact portion between the face plate 71 and the supporting frame 72 and the contact portion between the supporting plate 72 and the rear plate 1 to be airtight. Simultaneously, an airtight container (image-forming apparatus) 100 shown in FIG. 16 and having the inside kept at a high vacuum can be obtained.

Here, the above example is shown in which the "seal-bonding step" is performed in a reduced pressure (vacuum) atmosphere or in a non-oxidative atmosphere. However, the above "seal-bonding step" may be performed in the air. In this case, an exhaust tube for exhausting air from a space between the face plate and the rear plate is additionally provided in the airtight container 100. After the "seal-bonding step" is performed, air is exhausted from the inside of the airtight container so as to attain a pressure of $10^{-5}$ Pa or less. Subsequently, the exhaust tube is closed to obtain the airtight container (image-forming apparatus) 100 with the inside being kept at a high vacuum.

If the above "seal-bonding step" is performed in a vacuum, in order to keep the inside of the image-forming apparatus (airtight container) 100 at a high vacuum, it is preferable to provide a step of covering the metal back 73 (surface of the metal back which faces the rear plate 1) with a getter material between the step (I) and the step (J). The getter material used at this time is preferably an evaporating getter because it simplifies the covering step. Therefore, it is preferable to cover the metal back 73 with barium as the getter film. Furthermore, the step of covering with the getter is performed under a reduced pressure (vacuum) atmosphere as in the case of the above step (J).

Further, in the example of the image-forming apparatus described above, the spacer 101 is arranged between the face plate 71 and the rear plate 1. However, if the size of the image-forming apparatus is small, the spacer 101 is not necessarily required. In addition, when the interval between the rear plate 1 and the face plate 71 is about several hundreds of $\mu$m, the rear plate 1 and the face plate 71 can be directly bonded with the joining member without using the supporting frame 72. In such a case, the joining member also serves as an alternative material of the supporting frame 72.

In the present invention, furthermore, after the step (step (H)) of forming the gap 5' of the electron-emitting device 102, the positioning step (step (I)) and the seal-bonding step (step (J)) are performed. However, the step (H) may also be performed after the seal-bonding step (step (J)).

In addition, as described above, in the case in which the aforementioned "stabilization drive" is performed, it is performed after the above-mentioned "seal bonding step" and in a state in which a vacuum degree in the panel is $1.3\times10^{-3}$ Pa or more.

Embodiment

The present invention will be hereinafter described more in detail with reference to embodiments.

First Embodiment

In this embodiment, the electron-emitting device manufactured by the manufacturing method shown in FIGS. 2A to 2D was used. Details of the manufacturing process will be hereinafter described.

Step 1

A Pt film with a thickness of 100 nm was deposited on the glass substrate 1 by the sputtering method, and electrodes 2 and 3 consisting of the Pt film were formed with the photolithography technique (FIG. 2A). Note that a distance between the electrodes 2 and 3 was set to 10 $\mu$m. "PD200" manufactured by Asahi Glass Co., Ltd. was used as the substrate 1. Physical property values of this glass are as follows: specific heat: $c_{sub}$=653 J/kg·K, specific gravity: $\rho_{sub}$=2730 kg/m$^3$, and heat conductivity: $\lambda_{Sub}$=0.09 W/m·K. In addition, when an absorption coefficient of a wavelength around 800 nm of this glass was measured, it was approximately 5%. Further, a not-shown wiring for supplying a current is connected to the electrodes 2 and 3, respectively. The wiring is arranged on the substrate 1.

Step 2

A polyamic acid solution, which was a precursor of aromatic polyimide, was diluted by an N-methylpyrrolidone solvent in which 3% triethanolamine was dissolved and was applied over the entire surface of the substrate 1 by a spin coater, heated to 350° C. and baked under the vacuum condition, and imidized. Thereafter, a polyimide film was patterned in a rectangular shape crossing over the device electrodes 2 and 3 by applying a photoresist over the substrate and applying thereto steps of exposure, development and etching to it to manufacture the polymer film 4 (FIG. 2B). In this case, a thickness of the polyimide film 4 was 30 nm. The temperature T, at which this polyimide film had a resistivity of 0.1 Ωcm or less when it was heated and held for one hour in the vacuum degree of $1\times10^{-4}$ Pa or more, was 700° C., and activation energy of reaction was 3.2 eV.

Step 3

Next, using an Nd:YAG laser (beam diameter: 10 $\mu$m), energy irradiation (resistance reduction processing) on the polyimide film 4 in a condition in which the above-mentioned property values of the substrate were applied to the aforementioned formula (1) (condition satisfying the relation of W1), was performed under three conditions each for every irradiation time. In addition, energy irradiation (resistance reduction processing) on the polyimide film 4 in a condition in which the above-mentioned property values of the substrate were applied to the aforementioned formula (2) (condition satisfying the relation of W1'), was performed under three conditions each for every irradiation time. In this case, A and γ in formula (2) were set to 2.70 and 0.565, respectively. In addition, energy irradiation on the polyimide film 4 in a condition, which was obtained based on knowledge acquired through applying the resistance reduction processing over a long time, indicated by the solid line in FIG. 21, to the same polymer film (condition satisfying the relation of W2), was performed in one condition each for every irradiation time condition. Ea of the film obtained by applying the resistance reduction processing to the polyimide film 4 was measured for each condition. Results of this measurement are shown in Table 1.

Accordingly, it was found that the film had been changed to a film having carbon as a main component.

Step 4

Thereafter, the voltage application step was performed after cooling the film, which forms the gap 5 in a film, to which the resistance reduction processing was applied, by applying a rectangular pulse of 20 V and a pulse width of 1 msec between the electrodes 2 and 3.

Figure 23:
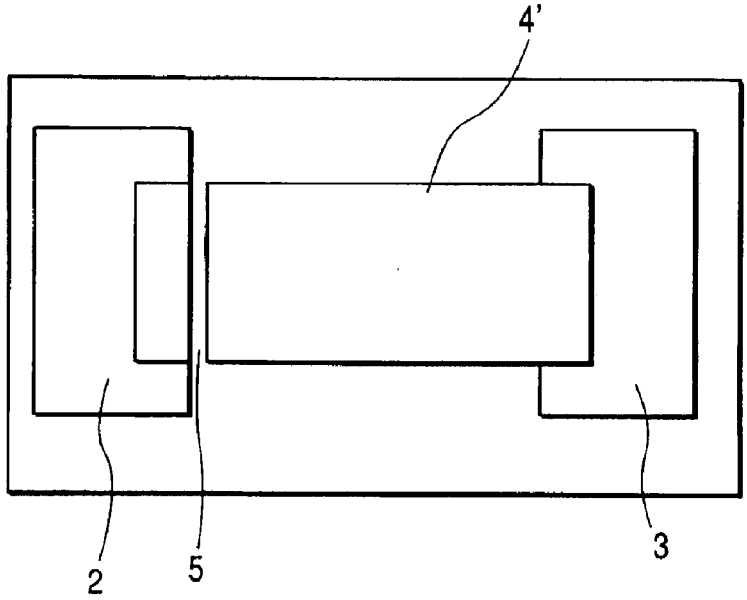
FIG. 23 is a schematic plan view of the electron-emitting device of the present invention.

An electron-emitting characteristic, a position where the gap 5 was formed, and Ea of the carbon film of the device, which have undergone each of the above-mentioned steps 1 to 4, were checked. As a result, satisfactory electron-emitting characteristics were obtained in the device to which the "resistance reduction processing" was applied under the condition of the formula (1). In addition, the gap 5 was formed in the vicinity of the electrode as shown in FIG. 23. However, the gap 5 was formed in the vicinity of the electrode 3 in some cases and formed in the vicinity of the electrode 2 in other cases. However, when the polymer film 4 was patterned in a trapezoid shape as shown in FIGS. 1A and 1B, the gap 5 could be formed in the vicinity of the electrode which had a shorter connection length with the polymer film.

TABLE 1

| Energy irradiation time | 0.1 mS | 5 mS | 50 mS | 1 S | 10 s | 10 min | 100 min |
|---|---|---|---|---|---|---|---|
| Ea of film applied with resistance reduction processing under W1 condition (eV) | 0.12 eV<br>0.29 eV<br>0.23 eV | 0.15 eV<br>0.21 eV<br>0.24 eV | 0.13 eV<br>0.20 eV<br>0.19 eV | 0.16 eV<br>0.18 eV<br>0.19 eV | 0.19 eV<br>0.20 eV<br>0.15 eV | 0.25 eV<br>0.30 eV<br>0.33 eV | ∞<br>∞<br>∞ |
| Position of gap (under W1 condition) | vicinity of electrode 2 | vicinity of electrode 2 | vicinity of electrode 2 | vicinity of electrode 2 | vicinity of electrode 2 | vicinity of electrode 2 | middle of electrode 2 and electrode 3 |
| Electron-emitting characteristics (under W1 condition) | ⊙ | ⊙ | ⊙ | ○ | ○ | Δ | x |
| Ea of film applied with resistance reduction processing under W1' condition (eV) | 0.12 eV<br>0.11 eV<br>0.09 eV | 0.15 eV<br>0.09 eV<br>0.10 eV | 0.13 eV<br>0.10 eV<br>0.08 eV | 0.16 eV<br>0.15 eV<br>0.17 eV | 0.19 eV<br>0.32 eV<br>0.25 eV | 0.49 eV<br>0.61 eV<br>0.55 eV | ∞<br>∞<br>∞ |
| Position of gap (under W1' condition) | vicinity of electrode 2 | vicinity of electrode 2 | vicinity of electrode 2 | vicinity of electrode 2 | vicinity of electrode 2 | middle of electrode 2 and electrode 3 | middle of electrode 2 and electrode 3 |
| Electron-emitting characteristics (under W1' condition) | ⊙ | ⊙ | ⊙ | ○ | Δ | x | x |
| Ea of film applied with resistance reduction processing under W2 condition (eV) | ∞ | ∞ | ∞ | 0.5 eV | 0.19 eV | 0.15 eV | 0.11 eV |
| Electron-emitting characteristics (under W2 condition) | x | x | x | x | ○ | ○ | ⊙ |

As shown in Table 1, in the case in which the "resistance reduction processing" was performed under the condition satisfying the formula (1) of the present invention, when the irradiation time τ was in the range of $1\times10^{-9}$ sec≦τ≦10 sec, a value of Ea was more dispersed as τ became smaller for every irradiation time, but was 0.3 eV or less in all the irradiation times. However, even under the condition of the formula (1), when the irradiation time τ deviated from the above-mentioned range, some values of Ea exceeded 0.3 eV. In the case in which the "resistance reduction processing" was performed under the condition satisfying the formula (2) of the present invention, a value of Ea was 0.2 eV or less when the irradiation time τ was in the range of $1\times10^{-9}$ sec≦τ≦1 sec, and the dispersion of the value of Ea for each irradiation time was smaller than that under the condition satisfying the formula (1). When the irradiation time τ deviated from the above-mentioned range, some values of Ea exceeded 0.3 eV.

The film obtained after applying the above-mentioned "resistance reduction processing" to the polyimide film (referred to as "carbon film" or "conductive film") was analyzed using an Auger electron spectrophotometer (AES).

On the other hand, in the area of τ≦10 sec, in the device to which the "resistance reduction processing" was applied under the conditions other than formula (1), a gap was formed around the middle between the electrode 2 and the electrode 3 or a gap was not formed, or in a worse case, the electrodes were broken down, and the device could not be used as an electron-emitting device. In addition, in the area of τ>10 sec, satisfactory electron-emitting characteristics were obtained in some cases and was not obtained in other cases even in the conditions other than W1.

In addition, when Ea of the conductive films (carbon films) 4' of the devices showing satisfactory electron-emitting characteristics were measured, the Ea of all the conductive films (carbon films) 4' were 0.2 eV or less including the one in which the Ea was 0.2 eV or more and 0.3 eV or less after the resistance reduction processing. Further, all the conductive films (carbon films) 4' had the smaller Ea compared with that after the resistance reduction processing.

In the measurement of the activation energy Ea in this embodiment, under the vacuum in the order of $1\times10^{-6}$ Pa, as shown in FIG. 19, the substrate 1 is heated from the normal temperature to 300° C. using a heater while applying a voltage (0.5 V) between the electrodes 2 and 3 and monitoring a current flowing to the film obtained by applying the "resistance reduction processing". Data of current and temperature obtained as a result of the measurement was Arrhenius-plotted ($I \propto \exp(-Ea/kT)$, I: current, k: Boltzmann constant, T: absolute temperature), and Ea was calculated from an inclination of the plotted data.

Figure 20:
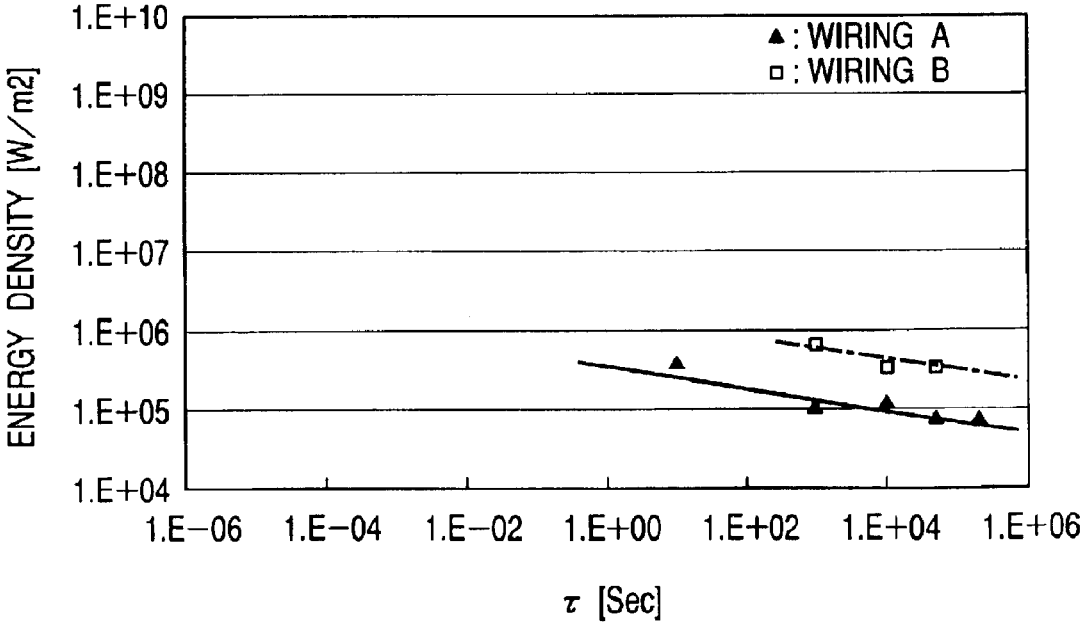
FIG. 20 is a schematic graph for illustrating a step of resistivity reduction processing of the present invention.

In addition, in this embodiment, a material of wiring connected to the above-mentioned electron-emitting device is changed to form the wiring on the substrate 1, and the same measurement as described above was performed. Then, as shown in FIG. 20, it was found that, in a range of $\tau>10$ sec, a condition of energy density required for obtaining satisfactory electron-emitting characteristics varies depending on the material of the wiring. However, as shown in FIG. 21, it is seen that, in a range of $\tau \leqq 10$ sec, even if the material of the wiring varies, satisfactory electron-emitting characteristics can be obtained if the above-mentioned condition of the formula (1) is satisfied. Further, in the range of $\tau \leqq 10$ sec, even if a film thickness or a structure of the wiring varies, satisfactory electron-emitting characteristics can be obtained if the above-mentioned condition of the formula (1) is satisfied.

From the above result as well, it is seen that, in the case in which a substrate on which a large number of electron-emitting devices and wiring for driving the electron-emitting devices are arranged such as those in an electron source and an image-forming apparatus (i.e., in the case in which wiring has already been formed on a substrate when the "resistance reduction processing" is performed), it is desirable to perform the "resistance reduction processing" under the condition indicated in the formula (1) of the present invention.

In addition, when the material of the substrate 1 was changed to quartz and the above-mentioned steps (1) to (4) were performed under a condition in which a physical property value of the quartz substrate is applied to the formula (1), an electron-emitting device having excellent electron-emitting characteristics could be obtained in the same manner. This relationship was the same in other substrate materials.

Figure 22:
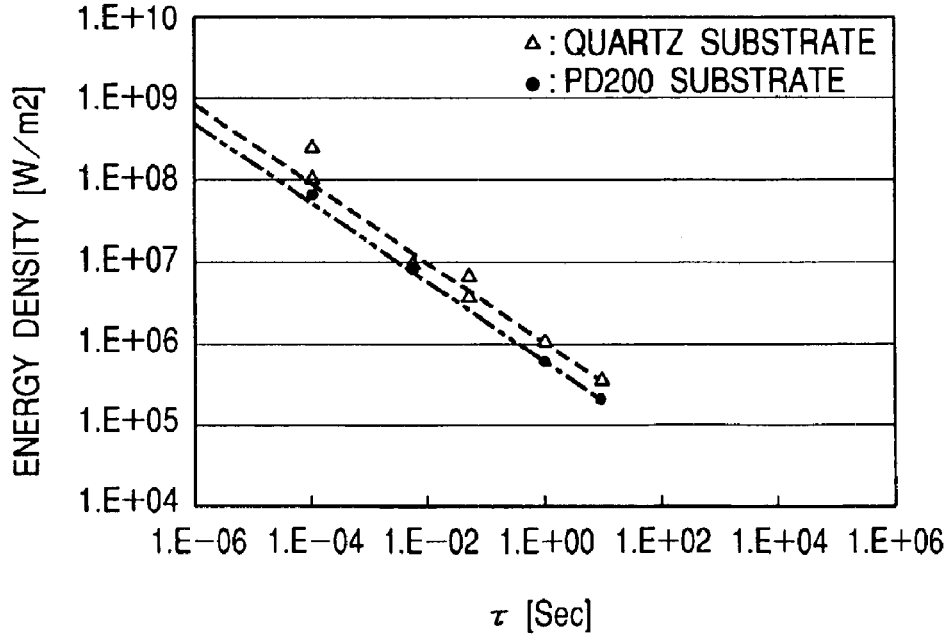
FIG. 22 is another schematic graph illustrating the step of resistance reduction processing of the present invention.

FIG. 22 shows a condition, in which each physical property value of a quartz substrate and a high strain point glass substrate (product name: PD200, manufactured by Asahi Glass Co., Ltd.) is applied to the formula (1), in the form of a graph. Note that, in the quartz substrate, $\lambda$=1.38 W/m·K, c=740 J/kg·K, $\rho$=2190 kg/m$^3$, and $(\lambda \cdot c \cdot \rho)$ 1/2=1495, and in the PD200 substrate, $\lambda$=0.9 W/m·K, c=653 J/kg·K, $\rho$=2730 kg/m$^3$, and $(\lambda \cdot c \cdot \rho)$ 1/2=1267. From FIGS. 21 and 22, it is seen that, if a substrate and wiring are fixed without depending on a type of the substrate, a wiring material, a film thickness of the wiring, and the like, in the area of $\tau \leqq 10$ sec, an irradiation time and energy in a unit area and a unit time required for the resistance reduction processing of the polymer film 4 is in a linear relationship in a Log—Log graph.

Further, the material of the substrate 1 was changed to quartz and the above-mentioned steps (1) to (4) were performed under a condition in which a physical property value of the quartz substrate is applied to the formula (2). It was assumed that A=2.82 and $\gamma$=0.553 in the formula (2). As in the case of the PD200 substrate, dispersion of Ea after the resistance reduction processing became smaller than that under the condition of the formula (1), the "voltage application step" thereafter could be processed in a short time, and an electron-emitting device having excellent electron-emitting characteristics with little dispersion could be obtained.

This relationship was the same in other substrate materials. From this fact, it is seen that, in the formula (2), if a substrate is fixed without depending on a wiring material, a film thickness of the wiring, and the like, in the range of $\tau \leqq 1$ sec, an irradiation time and energy in a unit area and for an unit time required for the resistance reduction processing of the polymer film 4 can also be approximated to a linear relationship in a Log—Log graph.

In addition, when a section SEM image in the vicinity of the gap 5 of the device showing satisfactory electron-emitting characteristics was observed, the device has a structure in which an electrode is exposed in the gap 5 as in the schematic view shown in FIG. 1B.

Second Embodiment

In this embodiment, an image-forming apparatus 100 schematically shown in FIG. 16 was manufactured. Reference numeral 102 denotes an electron-emitting device of the present invention. A method of manufacturing the image-forming apparatus of this embodiment will be described with reference to FIGS. 6 to 12, FIG. 16, FIGS. 17A and 17B.

FIG. 12 schematically shows a part of an electron source, which is constituted by a rear plate 1, a plurality of electron-emitting devices of the present invention formed on the rear plate 1, and wiring for applying a signal to each electron-emitting device, in an enlarged manner. Reference numeral 1 denotes a rear plate; 2 and 3, electrodes; 5', a gap; 4', a carbon film; 62, X-directional wiring; 63, Y-directional wiring; and 64, an interlayer insulating layer.

PD200 of Asahi Glass Co., Ltd. was used as the rear plate 1. Each property value is as follows:

Specific heat: $c_{sub}$=653 J/kg·K

Specific gravity: $\rho_{sub}$=2730 kg/m$^3$

Heat conductivity: $\lambda_{sub}$=0.90 W/m·K

In FIG. 16, the members denoted by the same reference numerals as those used in FIG. 12 indicate the same members in FIG. 12. Reference numeral 71 denotes a face plate in which a phosphor film 74 and a metal back 73 made of Al are laminated on a glass base plate. Reference numeral 72 denotes a supporting frame. The vacuum airtight container is composed by the rear plate 1, the face plate 71, and the supporting frame 72.

Hereinafter, this embodiment will be described with reference to FIGS. 6 to 12, 16 and 17A and 17B.

Step 1

A platinum (Pt) film with a thickness of 100 nm was deposited on the glass base plate 1 by a sputtering method, and the electrodes 2 and 3 made of the Pt film were formed using a photolithography technique (FIG. 6). Here, the distance between the electrodes 2 and 3 was 10 $\mu$m.

Step 2

Next, a silver (Ag) paste is printed on the substrate 1 by a screen printing method and is then baked by the application of heat, whereby the X-directional wiring 62 is formed (FIG. 7).

Step 3

Subsequently, an insulating paste is printed on the position that is an intersecting portion of the X-directional wiring 62 and the Y-directional wiring 63 by a screen printing method, and is then baked by the application of heat, whereby the insulating layer 64 is formed (FIG. 8).

Step 4

Further, an Ag paste is printed by a screen printing method and is then baked by the application of heat, whereby the Y-directional wiring 63 is formed. Thus, matrix wirings are formed on the substrate 1 (FIG. 9).

Step 5

A solution of polyamic acid (manufactured by Hitachi Chemical Co., Ltd.: PIX-L110) that is an aromatic polyimide precursor which is diluted with a 3% N-methylpyrrolidone solvent dissolved with triethanolamine was applied over the entire surface of the substrate 1 formed with the matrix wirings by means of a spin coater, and the resultant substrate 1 was baked while a temperature rises up to 350° C. under a vacuum condition to be made into an imide form. Thereafter, photoresist 18 is applied, and steps of exposure, developing, and etching are performed, whereby the polyimide film is patterned into a trapezoid shape so as to extend over the electrodes 2 and 3 to form the polymer film 4 with a trapezoid shape (FIG. 10).

A film thickness of the polyimide film 4 in this case was 30 nm. Temperature T, at which this polyimide film had a resistivity of 0.1 Ω·cm or less when it was heated and held for one hour in the vacuum degree of $1\times10^{-4}$ Pa or more, was 750° C. In addition, a crossing length of the electrode 2 and the polymer film 4 (substantially equivalent to "a length of a boundary line between the electrode and the polymer film on the surface of the substrate 1") was set to 100 μm and a crossing length of the electrode 3 and the polymer film 4 was set to 150 μm. Note that, when an absorption coefficient of a wavelength around 800 nm of this rear plate was measured, it was about 5%.

Step 6

Next, the rear plate 1 having formed thereon the electrode 2 and 3 consisting of Pt, the matrix wirings 62 and 63, and the polymer films 4 consisting of a polyimide film was set on a stage. One pulse of energy under the condition of the formula (1) conducted in the first embodiment was irradiated on the respective polymer films 4. The energy was irradiated with a pulse width of one pulse (irradiation time τ) set to 1 sec.

In this case, the stage was moved such that laser beams of a semiconductor laser serving as an energy source were irradiated on each device, and the resistance reduction processing was applied to the respective polymer films 4.

Step 7

The supporting frame 72 and a spacer 101 were adhered onto the rear plate 1 manufactured as described above by means of frit glass. Arrangement is made such that the rear plate 1, which is adhered with the spacer and the supporting frame, and the face plate 71 face each other (the surface on which the phosphor film 74 and the metal back 73 are formed and the surface on which the wirings 62 and 63 are formed face each other) (FIG. 17A). Note that frit glass was previously applied to a contact portion on the face plate 71 with the supporting frame 72.

Step 8

Next, seal bonding was performed by heating and pressurizing the opposing face plate 71 and rear plate 1 at 400° C. in a vacuum atmosphere at $10^{-6}$ Pa (FIG. 17B). An airtight container, inside of which is kept at a high vacuum, is obtained by the step. Note that, as the phosphor film 74, there was used one in which phosphors respectively emitting three primary colors (R, G, B) were arranged in stripe.

Finally, by applying rectangular pulses with a power of 25 V, between the electrodes 2 and 3 of each pair through the X-directional wiring and the Y-directional wiring, the gap 5 was formed in the film obtained by performing "resistance reduction processing" ("conductive film" or "carbon film" or "the conductive film" containing carbon as its main constituent) 4' (refer to FIG. 12). Thus, the image-forming apparatus 100 in this embodiment was manufactured.

In the image-forming apparatus completed as described above, a desired electron-emitting device was selected to be applied with a voltage of 22 V through the X-directional wiring and the Y-directional wiring, and the metal back 73 was applied with a voltage of 8 kV through a high voltage terminal Hv. As a result, a bright and satisfactory image was displayed for a long time.

Third Embodiment

In this embodiment, a "stabilization drive" step was applied to the image-forming apparatus manufactured in the second embodiment. Therefore, steps subsequent to the step 8 of the second embodiment will be hereinafter described.

Step 9

A drive pulse with a frequency 60 Hz, a pulse width 100 μsec, and a voltage 22V was repeatedly applied to each electron-emitting device through the X-directional wiring and the Y-directional wiring of the image-forming apparatus obtained in the above-mentioned step 8 to perform the stabilization drive of the panel. A peak value of the pulse applied at the time of this stabilization drive is the same as a peak value of a pulse to be applied at the time of actual drive. An emission current and a device current for one line along the respective X directions were measured, and the stabilization drive was finished when an early state current variation converged to a fixed value. Time required for this step was approximately 10 minutes under the above-mentioned condition.

In the image-forming apparatus completed as described above, when a desired electron-emitting device was selected and a drive voltage with an applied voltage 22 V, a pulse width 20 μsec, and a repeat frequency 60 Hz was applied to the electron-emitting device through the X-directional wiring and the Y-directional wiring, and a voltage of 8 kV was applied to the metal back 73 via the high voltage terminal Hv, a good image that was bright for a long time could be formed. In addition, when a luminance variation of a displayed image at this point was measured, a satisfactory result was obtained in that the variation was within 5% over a long period in all image areas.

Reference Example

Next, a comparative example will be described, in which the condition of the stabilization drive of the above-mentioned step 9 was changed in the same image-forming apparatus as the above-mentioned third embodiment.

First, an image-forming apparatus consisting of the same structure as the third embodiment was used to measure a luminance variation over a long time in the image-forming apparatus with the step of the stabilization drive not performed. According to the result, a luminance generally dropped largely in a short time, and a distribution (dispersion) of luminance drop also occurred. Thus, a good image-forming apparatus was not obtained.

Next, the stabilization drive of a panel was performed with the drive condition of step 9 shown in the third embodiment changed to a repeat frequency 60 Hz, a pulse width 10 μsec, and a voltage 22 V. Then, time longer than the time required in the third embodiment was required until both an emission current Ie and a device current If converged to fixed values.

The above-mentioned condition is equivalent to a drive condition at the time when an image was displayed by line-sequential drive in an image-forming apparatus equivalent to XGA. This means that a long time is required for stabilization of the device with drive equivalent to the image display condition and indicates effectiveness of the present invention.

Fourth Embodiment

In this embodiment, the image-forming apparatus 100 was manufactured, which is the same as that in the third embodiment and schematically shown in FIG. 16. As an electron-emitting device 102, the manufacturing method of which was already described with reference to FIGS. 1A and 1B and FIGS. 2A to 2D, was used. The description of a main manufacturing process will be omitted because it is the same as that in the second embodiment. However, the manufacturing process was performed by placing the rear plate 1 in the reduced pressure atmosphere of approximately $1\times10^{-6}$ Pa and irradiating electron beams with an acceleration voltage=10 kV and a current density=0.1 mA on a polymer film in the aforementioned "resistance reduction processing".

In the rear plate 1 obtained in this way, a rectangular pulse with a voltage 25 V and a pulse width 1 msec was applied between the electrodes 2 and 3 through the X-directional wiring and the Y-directional wiring as in the third embodiment in the reduced pressure atmosphere, whereby the gap 5 was formed.

The supporting frame 72 and a spacer 101 were adhered onto the rear plate 1 manufactured as described above by means of frit glass. Arrangement is made such that the rear plate 1, which is adhered with the spacer and the supporting frame, and the face plate 71 face each other (the surface on which the phosphor film 74 and the metal back 73 are formed and the surface on which the wirings 62 and 63 are formed face each other) (FIG. 17A). Note that frit glass was previously applied to a contact portion on the face plate 71 with the supporting frame 72.

Next, seal bonding was performed by heating and pressurizing the opposing face plate 71 and rear plate 1 at 400° C. in a vacuum atmosphere at $10^{-6}$ Pa (FIG. 17B). An airtight container (panel), inside of which is kept at a high vacuum, is obtained by the step. Note that, as the phosphor film 74, there was used one in which phosphors respectively emitting three primary colors (R, G, B) were arranged in stripe.

Next, a drive pulse with a frequency 600 Hz, a pulse width 100 μsec, and a voltage 22V was repeatedly applied to each electron-emitting device through the X-directional wiring and the Y-directional wiring of the image-forming apparatus obtained in the above-mentioned step to perform the stabilization drive of the panel. An emission current and a device current for one line along the respective X directions were measured, and the stabilization drive was finished when an early state current variation converged to a fixed value. Time required for this step was approximately 1 minute under the above-mentioned condition and it was possible to perform stabilization in a shorter time compared to the third embodiment.

In the image-forming apparatus completed as described above, when a desired electron-emitting device was selected and a drive voltage with an applied voltage 22 V, a pulse width 20 μsec, and a repeat frequency 60 Hz was applied to the electron-emitting device through the X-directional wiring and the Y-directional wiring, and a voltage of 8 kV was applied to the metal back 73 through the high voltage terminal Hv, a satisfactory image that was bright for a long time could be formed. In addition, when a luminance variation of a displayed image at this point was measured, a satisfactory result was obtained in that the variation was within 5% over a long period in all image areas.

According to the present invention, the manufacturing process of the electron-emitting device can be simplified, and also, the image-forming apparatus which allows excellent display quality to be maintained for a long period of time can be manufactured at low cost.

What is claimed is:

1. A method for manufacturing an electron-emitting device, comprising the steps of:

(A) providing a substrate on which a pair of electrodes and a polymer film are arranged, the polymer film connecting the electrodes;

(B) reducing a resistivity of the polymer film by irradiating an energy beam onto the polymer film; and (C) forming a gap in a film obtained by reducing a resistivity of the polymer film, wherein, in the step (B), assuming that an energy intensity of the beam given in a unit area in a unit time as W W/m$^2$, W satisfies a formula $W \geqq 2\times T\times(\rho_{sub}\cdot C_{sub}\cdot\lambda_{sub}/\tau)^{1/2}$, where T is defined as a temperature ° C. at which the polymer film is heated for one hour in a vacuum degree of $1\times10^{-4}$ Pa to reduce a resistivity of the polymer film measured at a room temperature to 0.1 Ω·cm, $C_{sub}$ is a specific heat J/kg·K of the substrate, $\rho_{sub}$ is a specific gravity kg/m$^3$ of the substrate, $\lambda_{sub}$ is a thermal conductivity W/m·K of the substrate, and τ is an irradiation time in the range of $10^{-9}$ sec to 10 sec.

2. A method for manufacturing an electron-emitting device according to claim 1, wherein, in the step of reducing the resistivity of the polymer film, when τ is taken in the range of $10^{-9}$ sec to 1 sec, the energy intensity W further satisfies a formula $W \geqq A\times T\times(\rho_{sub}\cdot C_{sub}\cdot\lambda_{sub})^{1/2}\times\tau^{-\gamma}$, where A is a constant and $2.5 \leqq A \leqq 3.0$, γ is a constant and satisfies $0.5 \leqq \gamma \leqq 0.6$.

3. A method for manufacturing an electron-emitting device according to claim 1, wherein an activation energy necessary for reducing the resistivity of the polymer film to 0.1 Ω·cm or less is 4 eV or less.

4. A method for manufacturing an electron-emitting device according to claim 1, wherein the energy beam is irradiated onto the polymer film plural times.

5. A method for manufacturing an electron-emitting device according to claim 1, wherein the energy beam is a particle beam selected from a group of electron beam and ion beam.

6. A method for manufacturing an electron-emitting device according to claim 1, wherein the energy beam is a light beam emitted from a light source selected from a group of a laser, a xenon light source and a halogen light source.

7. A method of manufacturing an electron-emitting device according to claim 1, wherein the polymer is made of at least one selected from a group consisting of aromatic polyimide, polyphenylene oxadiazole, and polyphenylene vinylene.

8. A method for manufacturing an electron-emitting device according to claim 1, further comprising the step of:

flowing a current between the electrodes by applying a voltage between the electrodes under a reduced pressure atmosphere after the gap has been formed.

9. A method of manufacturing an image display apparatus that comprises:

an electron source having a plurality of electron-emitting devices; and a light emitting member for emitting light when being irradiated by of electrons emitted from the electron source, wherein the electron source is manufactured by a method for manufacturing an electron source as set forth in claim 1.

10. A method for manufacturing an image display apparatus according to claim 9, further comprising the step of:

flowing a current between the electrodes by applying a voltage between the electrodes under a reduced pressure atmosphere after the gap has been formed.

11. A method of manufacturing an image display apparatus according to claim 10, wherein the voltage applied between the electrodes is a pulse voltage with a fixed peak value, and a pulse width of the pulse voltage is larger than a pulse width used at the time of actual drive of forming an image.

12. A method of manufacturing an image display apparatus according to claim 10, wherein the voltage applied between the electrodes is a pulse voltage with a fixed peak value, and a pulse duty defined by a ratio of pulse width to pulse period is larger than a pulse duty used at the time of actual drive of forming an image.

13. A method of manufacturing an image display apparatus according to claim 11, wherein the voltage applied between the electrodes is a pulse voltage with a fixed peak value, and a pulse interval of the pulse voltage is shorter than a pulse interval used at the time of actual drive of forming an image.

14. A method of manufacturing an image display apparatus according to claim 12, wherein the voltage applied between the electrodes is a pulse voltage with a fixed peak value, and a pulse interval of the pulse voltage is shorter than a pulse interval used at the time of actual drive of forming an image.

15. A method for manufacturing an electron-emitting device, comprising the steps of:

(A) providing a substrate on which a polymer film is arranged;

(B) reducing a resistivity of the polymer film by irradiating an energy beam onto the polymer film; and wherein, in the step (B), assuming that an energy intensity of the beam given in a unit area in a unit time as W $W/m^2$, W satisfies a formula $W \geqq 2 \times T \times (\rho_{sub} \cdot C_{sub} \cdot \lambda_{sub}/\tau)^{1/2}$, where T is defined as a temperature ° C. at which the polymer film is heated for one hour in a vacuum degree of $1 \times 10^{-4}$ Pa to reduce a resistivity of the polymer film measured at a room temperature to 0.1 Ω·cm, $C_{sub}$ is a specific heat J/kg·K of the substrate, $\rho_{sub}$ is a specific gravity $kg/m^3$ of the substrate, $\lambda_{sub}$ is a thermal conductivity W/m·K of the substrate, and $\tau$ is an irradiation time in the range of $10^{-9}$ sec to 10 sec.

* * * * *

UNITED STATES PATENT AND TRADEMARK OFFICE

CERTIFICATE OF CORRECTION

PATENT NO. : 6,896,571 B2 
DATED : May 24, 2005
INVENTOR(S) : Hironobu Mizuno et al.

It is certified that error appears in the above-identified patent and that said Letters Patent is hereby corrected as shown below:

Title page,
Item [56], References Cited, U.S. PATENT DOCUMENTS,
"6,379,211 B1 4/2002 Onishi et al. …… 445/73" should read
-- 6,379,211 B2 4/2002 Onishi et al …… 445/73 --.

Column 4,
Line 2, "comprises" should read -- comprise --.

Column 8,
Line 36, "is" should read -- are --.

Column 10,
Line 29, "processing" should read -- processed --.

Column 13,
Line 55, "$W\alpha[38.2/\{In(tr)+30\}\times T-300]\times(P_{sub}{}^{19}\ C_{sub}\cdot\lambda_{sub}/\tau)^{1/2}$ (6)" should read
-- $W\alpha[38.2/\{In(tr)+30\}\times T-300]\times(P_{sub}\cdot C_{sub}\cdot\lambda_{sub}/\tau)^{1/2}$ (6) --.

Column 24,
Line 54, "was" should read -- were --.

Column 25,
Lines 44 and 54, "is" should read -- are --.

Column 27,
Line 27, "electrode" should read -- electrodes --.

UNITED STATES PATENT AND TRADEMARK OFFICE

CERTIFICATE OF CORRECTION

PATENT NO. : 6,896,571 B2
DATED : May 24, 2005
INVENTOR(S) : Hironobu Mizuno et al.

It is certified that error appears in the above-identified patent and that said Letters Patent is hereby corrected as shown below:

Column 30,
Line 57, "of" should be deleted.

Signed and Sealed this

Fourteenth Day of February, 2006

JON W. DUDAS
*Director of the United States Patent and Trademark Office*